US010053823B2

(12) United States Patent
Kuhn et al.

(10) Patent No.: US 10,053,823 B2
(45) Date of Patent: Aug. 21, 2018

(54) METHOD AND APPARATUS FOR SEALING CRACKS

(71) Applicant: NICHE INDUSTRIES ONTARIO INC., New Hamburg (CA)

(72) Inventors: Leigh Kuhn, New Hamburg (CA); Eric Haiser, Kitchener (CA)

(73) Assignee: NICHE INDUSTRIES ONTARIO INC., New Dundee (CA)

( * ) Notice: Subject to any disclaimer, the term of this patent is extended or adjusted under 35 U.S.C. 154(b) by 0 days.

(21) Appl. No.: 15/636,588

(22) Filed: Jun. 28, 2017

(65) Prior Publication Data

US 2017/0298579 A1 Oct. 19, 2017

Related U.S. Application Data

(63) Continuation of application No. 15/051,263, filed on Feb. 23, 2016, now Pat. No. 9,739,021.

(51) Int. Cl.

| | |
|---|---|
| ***E01C 19/00*** | (2006.01) |
| ***E01C 19/45*** | (2006.01) |
| ***E01C 11/00*** | (2006.01) |
| ***E01C 23/06*** | (2006.01) |

(52) U.S. Cl.
CPC ..... *E01C 19/45* (2013.01); *E01C 11/005* (2013.01); *E01C 23/06* (2013.01)

(58) Field of Classification Search
CPC ..... E01C 19/45; E01C 11/005; E01C 23/06
USPC ..... 404/75, 111
See application file for complete search history.

(56) References Cited

U.S. PATENT DOCUMENTS

| | | | | |
|---|---|---|---|---|
| 1,086,911 | A * | 2/1914 | Gailor | D06F 1/06 126/345 |
| 1,751,565 | A | 3/1930 | Talbot | |
| 1,924,636 | A * | 8/1933 | Burket | E01C 23/0973 126/343.5 A |
| 2,420,410 | A | 5/1947 | Blankner | |
| 2,893,642 | A | 7/1959 | Callery | |
| 3,266,392 | A | 8/1966 | Angelini | |
| 4,620,645 | A | 11/1986 | Hale | |
| 4,732,109 | A | 3/1988 | Selby | |
| 4,831,958 | A | 5/1989 | Selby | |
| 5,036,119 | A | 11/1991 | Berggren et al. | |
| 5,223,005 | A * | 6/1993 | Avondoglio | B01D 46/0068 55/291 |
| 5,325,994 | A | 7/1994 | Mizialko et al. | |
| 6,109,826 | A * | 8/2000 | Mertes | E01C 19/45 392/472 |
| 6,439,806 | B1 | 8/2002 | Dillingham | |
| 6,935,331 | B2 | 8/2005 | Farmer | |

(Continued)

*Primary Examiner* — Raymond W Addie
(74) *Attorney, Agent, or Firm* — Norton Rose Fulbright Canada LLP; Christopher N. Hunter

(57) ABSTRACT

A portable dispensing device for dispensing a crack sealant, comprises an outer housing, a melting kettle for holding crack sealant to be melted, a guide mechanism in the housing below the kettle for positioning a burner below the kettle, a burner assembly removably mounted in an air gap between the outer housing and the melting kettle using the guide mechanism, the removable burner assembly configured to direct a flame against a surface of the melting kettle, a control valve fluidly connected to the melting kettle to dispense melted crack sealant, and a handle assembly for manually moving the portable dispensing device.

19 Claims, 20 Drawing Sheets

(56) References Cited

U.S. PATENT DOCUMENTS

| | | | | |
|---|---|---|---|---|
| 8,262,833 | B2 | 9/2012 | Dyal et al. | |
| 8,465,225 | B2 * | 6/2013 | Groulx | E01C 19/08 298/1 H |
| 8,992,120 | B2 * | 3/2015 | Fredrickson | G06F 17/5081 404/107 |
| 9,132,570 | B2 * | 9/2015 | Trimborn | E01C 19/08 |

* cited by examiner

METHOD AND APPARATUS FOR SEALING CRACKS

CROSS REFERENCE TO RELATED APPLICATIONS

This application is a continuation of U.S. patent application Ser. No. 15/051,263 filed on Feb. 23, 2016 and issued as U.S. Pat. No. 9,739,021, the contents of which are hereby incorporated by reference.

FIELD

This relates to the field of pavement maintenance, and in particular, to methods and devices for sealing cracks in paved surfaces such as roads and driveways.

BACKGROUND

Paved surfaces such as roads and driveways are prone to wear and tear over time. Surface deterioration may be caused, for example, by overloading, seepage, poor surface drainage, improper maintenance, improper design, and the weather.

Cracks may commonly form in paved surfaces and driveways due to application of stress from traffic, extreme weather conditions, or the like. If left untreated, the cracking can cause roughness and eventually structural failure. Water can seep into the cracks and further degrade the surface and form potholes.

Proper maintenance is important to usability of paved surfaces. Small-scale distresses, such as cracks, can be a source of distraction or frustration for a driver. These cracks may grow if left unattended, which can become a safety hazard.

One way to repair paved surfaces is to fill the cracks with sealant such as melted rubber, asphalt, or bitumen. Various machines have been developed for applying crack-filling material to roads and driveway surfaces. Such machines typically have a melting kettle and a torch for heating the kettle. Unfortunately, existing machines tend to be cumbersome to move and difficult to operate and service. Moreover, existing torch designs tend to be difficult to light, susceptible to flameouts due to wind, and inefficient to operate.

SUMMARY

An example portable dispensing device for dispensing a crack sealant, comprises: an outer housing; a melting kettle for holding the crack sealant to be melted; a guide mechanism in the housing below the kettle for positioning a burner below the kettle; a burner assembly removably mounted in an air gap between the outer housing and the melting kettle using the guide mechanism, the removable burner assembly configured to direct a flame against a surface of the melting kettle; a control valve fluidly connected to the melting kettle to dispense melted crack sealant; and a handle assembly for manually moving the portable dispensing device.

An example method for dispensing a crack sealant, comprises: inserting sealant in a melting kettle within a housing of a dispenser; inserting a burner assembly through an opening in the dispenser housing so that a burner of the burner assembly is positioned to direct a flame upwardly against an underside of the melting kettle; igniting the flame at the burner by operation of an ignition control device outside the housing; and depositing molten sealant into the crack by manually moving the dispenser along the crack.

An example portable dispensing device for dispensing a crack sealant comprises: an outer housing; a melting kettle for holding the crack sealant to be melted; a guide mechanism in the housing below the kettle for positioning a burner below the kettle; a burner assembly removably mounted in an air gap between the outer housing and the melting kettle using the guide mechanism, the removable burner assembly configured to direct a flame against a surface of the melting kettle; and a control valve fluidly connected to the melting kettle to dispense melted crack sealant.

Other aspects will be apparent from the description and drawings provided herein.

BRIEF DESCRIPTION OF DRAWINGS

In the figures which illustrate example embodiments.

DETAILED DESCRIPTION

Figure 1:
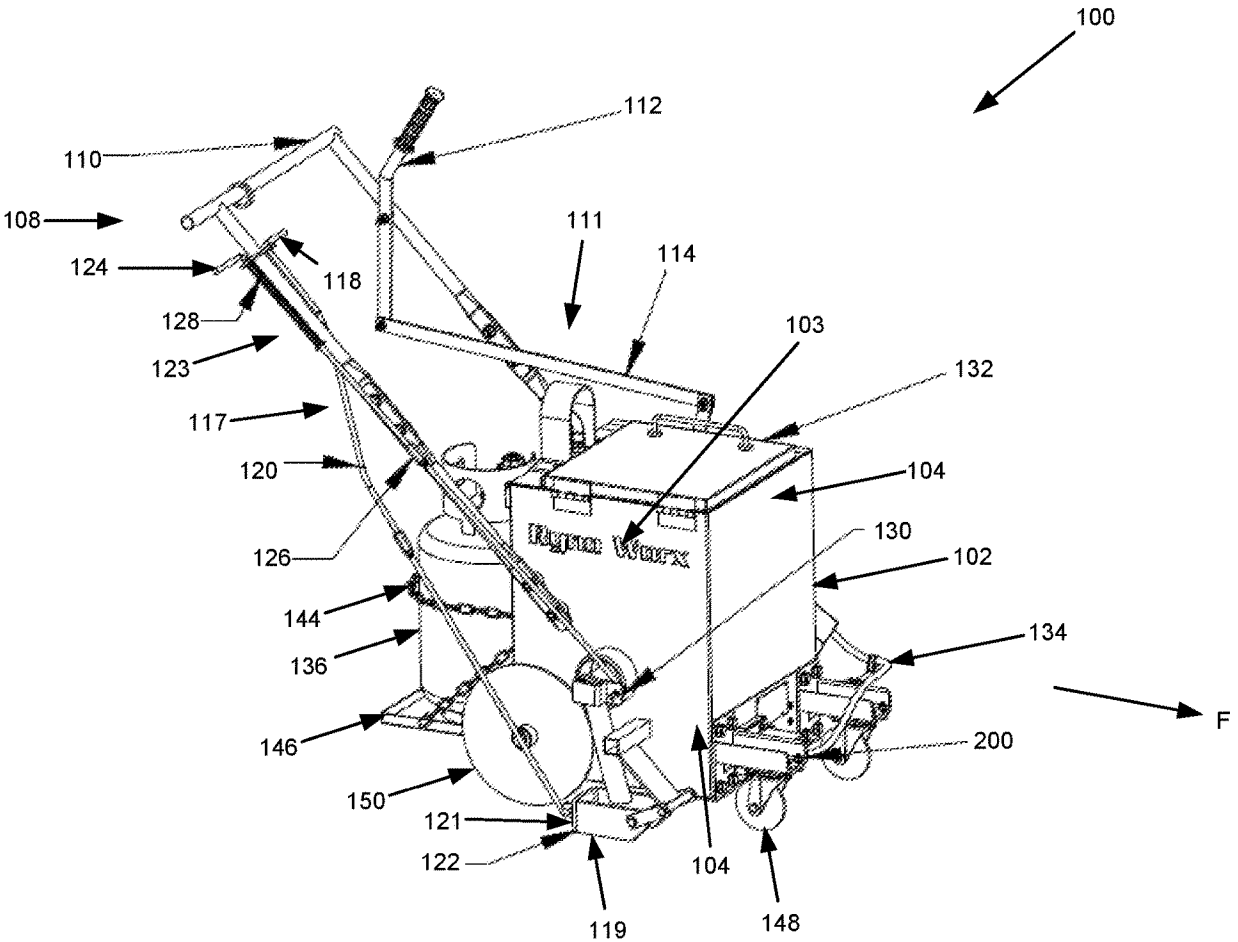
FIG. 1 is a front perspective view of a portable dispensing device.
Figure 2:
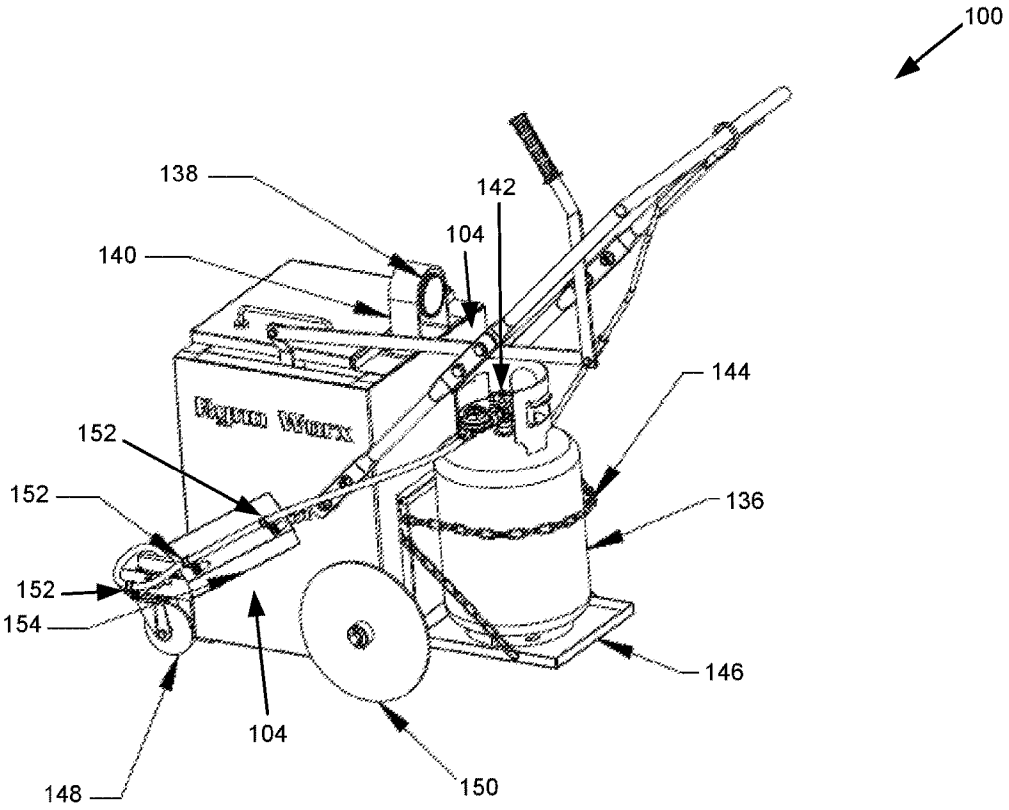
FIG. 2 is a rear perspective view of the portable dispensing device of FIG. 1.

FIGS. 1-2 are front and rear perspective views of an example portable dispensing device 100, which may melt crack sealant and to fill cracks in a paved surface with the melted sealant. The sealant may be made of a material or a combination of materials appropriate to fill cracks formed in a paved surface such as a road or driveway. For example, the sealant may be rubber, asphalt, or bitumen. In some examples, the sealant may be Dura-Fill HS™ or Dura-Fill PL™ sealant produced by P&T Products Inc. of Sandusky, Ohio, USA; Nuvo Elite B™ produced by Maxwell Products Inc. of Salt Lake City, Utah, USA; or Superflex HT™ produced by Crafco Inc. of Chandler, Ariz., USA. In other examples, the sealant may be a suitable asphalt sealant or non-asphalt sealant. Portable dispensing device 100 may be guided along one or more cracks and may dispense the melted sealant into the cracks.

Portable dispensing device 100 may include a housing 102. As depicted, housing 102 has a generally rectangular shape with four housing side walls 104. Housing side walls 104 may be joined (e.g. welded) together to form the sides of housing 102. In some embodiments, housing 102 may be a different shape, for example, cylindrical. Housing 102 may include one or more vents 103 at or near the top of housing 102 to ventilate warm air and exhaust fumes as solid sealant is being melted. For example, as depicted, vents 103 are located proximate the top of side walls 104.

Figure 8:
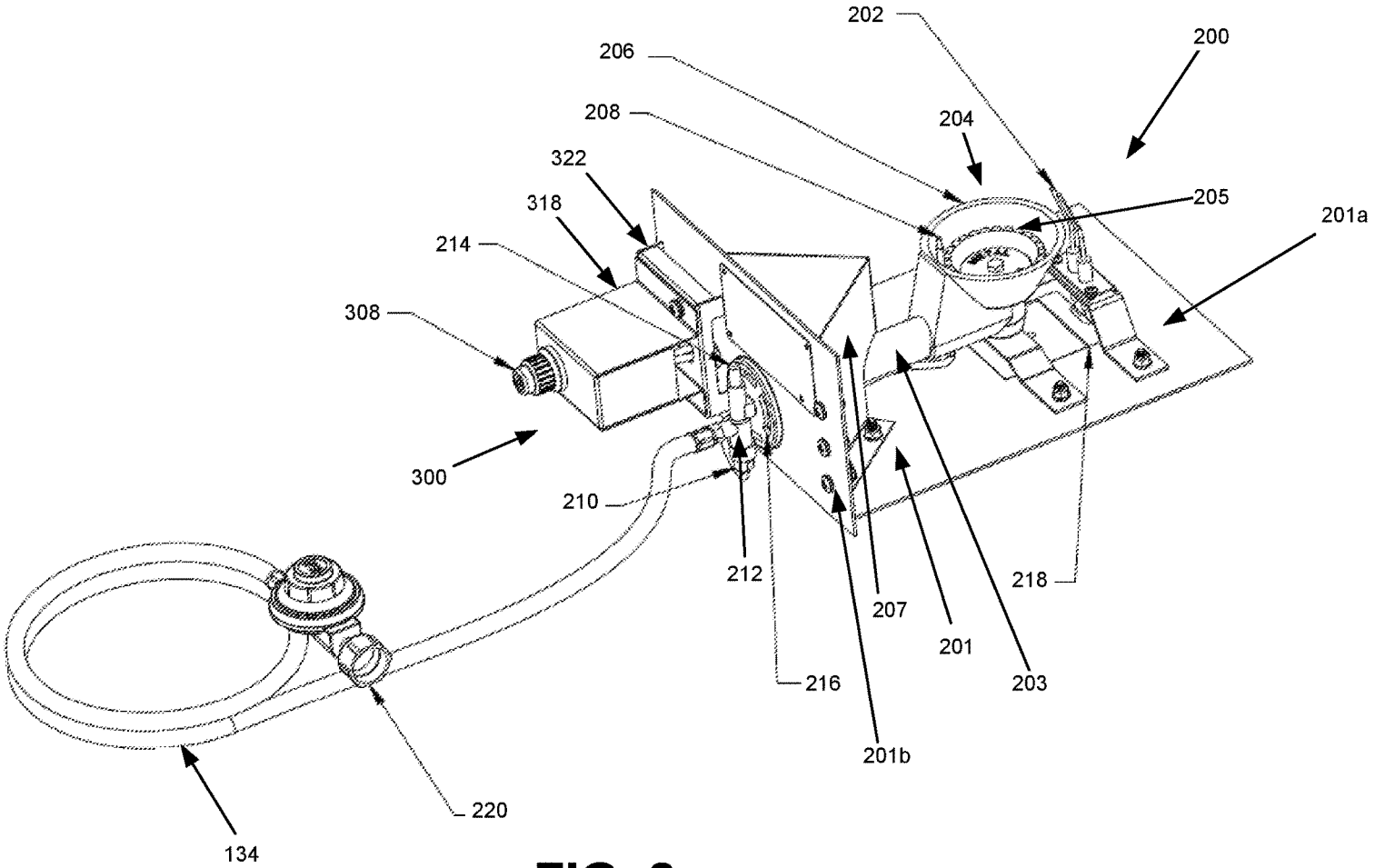
FIG. 8 is a perspective view of a removable burner assembly.
Figure 9:
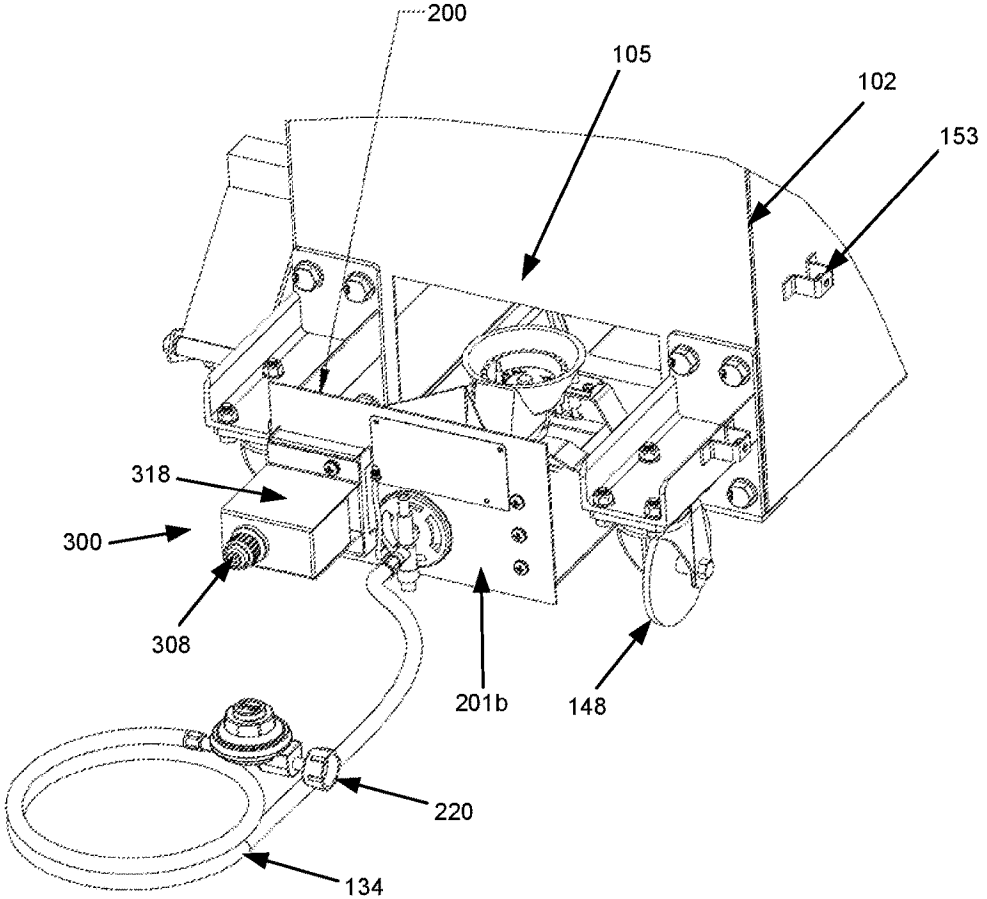
FIG. 9 is a perspective view of the removable burner assembly of FIG. 8, partially slidably inserted or partially slidably removed from the portable dispensing device of FIG. 1.
Figure 10:
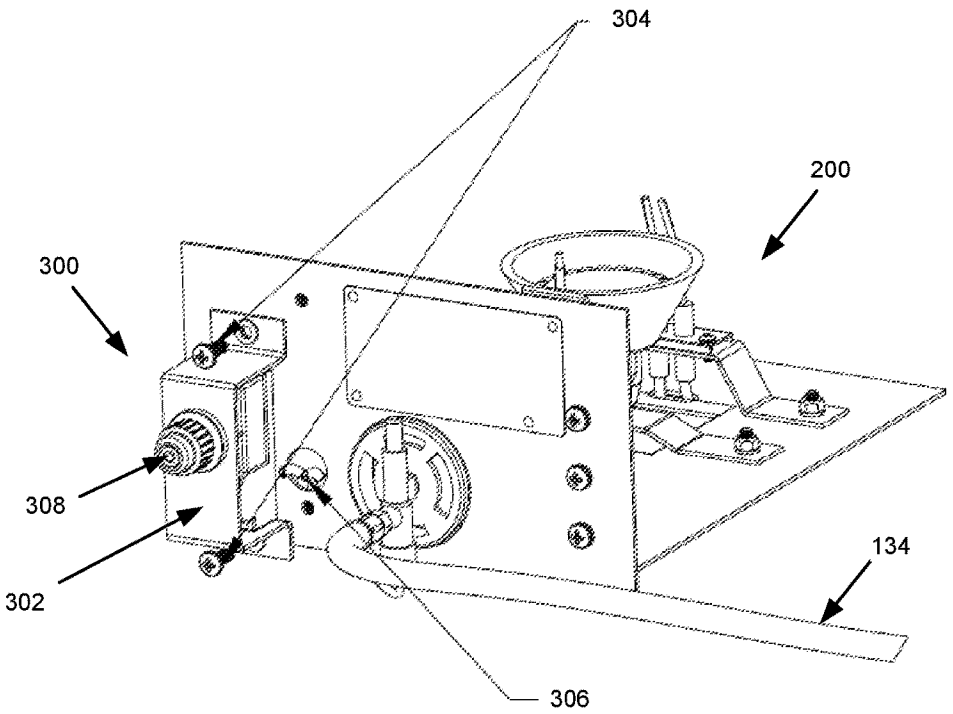
FIG. 10 through FIG. 15 are perspective views depicting the installation of an ignition assembly on the removable burner assembly of FIG. 8.

As will be described in further detail below, housing 102 may contain a kettle 106 (FIG. 5) and a removable burner assembly 200 (FIG. 8). Solid sealant may be placed inside kettle 106 through the top of housing 102.

Housing 102 may be sized so that a pre-determined amount of solid sealant may be melted in kettle 106 while also being able to contain removable burner assembly 200, sufficiently sized and rated to melt the pre-determined amount of solid sealant within a certain period of time, without being too heavy to operate portable dispensing device 100.

Portable dispensing device 100 may include one or more front casters 148 and one or more rear wheels 150 and may be manually movable by an operator by rolling on the casters 148 and wheels 150. Front casters 148 may be mounted to housing 102 e.g. using appropriate fasteners, such as bolts, or by welding. Front casters 148 may comprise a pivoting wheel for allowing portable dispensing device 100 to turn left or right. Front casters 148 may include bearings between the casters 148 and brackets carrying the casters 148, and housing 102, to permit pivoting of the casters 148.

Rear wheels 150 may be mounted to one or more axles on housing 102. For example, rear wheels 150 may be carried on axles and secured to the axles using washers, cotter pins, or the like. The axles may be received in bushings or bearings carried in the wheels 150.

As depicted in FIG. 1 and FIG. 2, portable dispensing device 100 includes two front casters 148 and two rear wheels 150.

Also depicted in FIG. 1 are a lid 132 and a fuel hose 134. Lid 132 may be removably fastened to housing 102, for example, with one or more screws and hinges. Lid 132 may include a handle so that lid 132 may be opened or closed.

Lid 132 may provide a barrier between the warm interior of housing 102 and the external area surrounding portable dispensing device 100. Lid 132 may prevent melted sealant from exiting kettle 106 from the top of housing 102.

Fuel hose 134 may provide a fluid connection between a fuel tank 136 and removable burner assembly 200. Fuel hose 134 may be made of a material appropriate for the fuel contained in fuel tank 136. For example, fuel hose 134 may be made of plastic or rubber. Fuel hose 134 may have a protected sheath, e.g. a braided steel sheath.

Fuel tank 136 may contain a pressurized fuel gas such as propane or natural gas. Fuel tank 136 may include a fuel tank valve 142. Fuel tank valve 142 may be opened, such as by turning a knob on fuel tank valve 142, to release fuel from fuel tank 136. Fuel from fuel tank 136 may be supplied to removable burner assembly 200 by fuel hose 134 to be ignited into a flame that may heat the solid sealant loaded in kettle 106.

Fuel tank 136 may be rested and secured on a fuel tank shelf 146 using a fuel tank chain 144. Fuel tank chain 144 and fuel tank shelf 146 may be secured to housing 102 using appropriate fastening devices. For example, fuel tank shelf 146 may include tabs that may be inserted into slots built into housing 102. Fuel tank chain 144 may be welded onto fuel tank shelf 146, and may be secured to housing 102 using hooks built into housing 102. Fuel tank 136 may be the source of fuel for removable burner assembly 200 to heat and melt sealant in kettle 106 to be dispensed from control valve 130 onto a crack.

Portable dispensing device 100 also includes a control assembly 108. Control assembly 108 may include a handle bar 110, an agitation assembly 111, a shoe control assembly 117, and a valve control assembly 123.

Handle bar 110 may be connected to housing 102, e.g. by welding or using fastening devices such as a combination of threaded studs, washers, and nuts, or by another appropriate fastening device. Handle bar 110 extends upwardly from housing 102 for grasping and pushing by an operator to move portable dispensing device 100 along a desired path. Other portions of control assembly 108 may be mounted on or proximate to handle bar 110 for ease of use by the operator.

Figure 5:
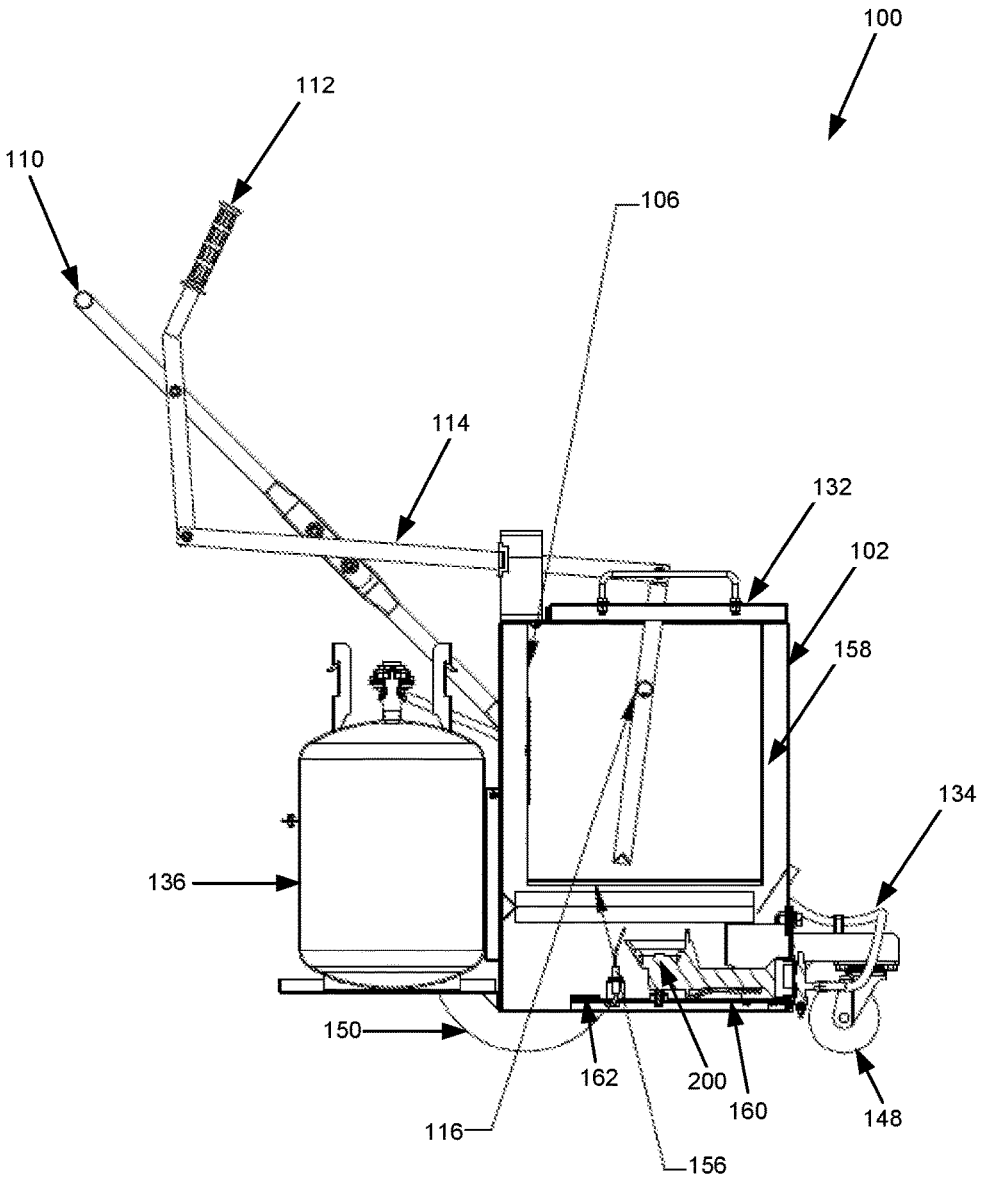
FIG. 5 is a cross-sectional view of the portable dispensing device of FIG. 4 along line V-V shown in FIG. 4.

Agitation assembly 111 may include an agitation handle 112, an agitation arm 114, and an agitator 116 (FIG. 5).

Agitation handle 112 may be connected to agitation arm 114 and agitator 116. Agitator 116 may extend into housing 102 for reception in kettle 106 (FIG. 5). Agitation handle 112, agitation arm 114, and agitator 116 may be pivotably attached to one another and to handle bar 110 or housing 102. For example, agitation arm 114 may be fastened together with agitation handle 112 using a combination of bolts, washers, and locknuts. Agitator 116 may be actuated using agitation handle 112 to stir contents of kettle 106.

As will be apparent, stirring of sealant within kettle 106 may promote even temperature distribution and melting, which may contribute to maintaining the desired viscosity of the melted sealant. Moreover, when heated, some types of sealants may melt into a heterogeneous mixture. If overheated, portions of the mixture may solidify and separate from the remainder of the mixture. Such solids may form crystals within kettle 106. Thus, stirring of sealant may mix sealant components and may limit or prevent solidification or crystallization of sealant inside kettle 106.

Valve control assembly 123 may include a valve control handle 124, a valve control arm 126, a valve control spring 128, and a control valve 130.

Valve control handle 124 may be connected to valve control arm 126, valve control spring 128, and control valve 130. For example, valve control arm 126 may be fastened to valve control handle 124 by threading valve control arm 126 into a sleeve of valve control handle 124. A nut may be tightened to secure valve control handle 124 and valve control arm 126 together. Valve control arm 126 and control valve 130 may be secured together using a cotter pin. In some embodiments, valve control handle 124 may include valve control spring 128.

Control valve 130 has a closed position and an open position. In its closed position, control valve 130 may prevent melted sealant from exiting kettle 106 and housing 102. In its open position, control valve 130 may allow melted sealant to exit kettle 106 and housing 102, so melted sealant may be dispensed onto a crack in a paved surface.

Valve control spring 128 may bias control valve 130 to be in its closed position by default when valve control handle 124 is not engaged. Therefore, melted sealant does not exit kettle 106 unless valve control handle 124 is engaged.

Shoe control assembly 117 may include a shoe control handle 118, a shoe control arm 120, and a shoe 122.

Shoe 122 may be pivotably mounted to housing 102 below an outlet of control valve 130. Shoe 122 may be moved between a raised position as depicted in FIG. 1, and a lowered position in which it drags on the ground while portable dispensing device 100 is moved. Shoe 122 may have a shoe outlet 119 and a grading blade 121 positioned behind shoe outlet 119. Shoe 122 may be configured so that, as portable dispensing device 100 is moved forwardly in direction F depicted in FIG. 1, sealant may be dispensed through shoe outlet 119 into a crack, with shoe 122 in its lowered position, grading blade 121 may smooth out the melted sealant to reduce bumps or protrusions that may form after the melted sealant has solidified. Shoe 122 may also be used by an operator as a guide for positioning portable dispensing device 100 relative to the crack for accurate dispersal of sealant.

Shoe control handle 118 may be connected to shoe control arm 120 and shoe 122. For example, shoe control arm 120 may be fastened together with shoe control handle 118 by threading shoe control arm 120 into a sleeve of shoe control handle 118. A nut may be tightened to secure shoe control handle 118 and shoe control arm 120 together. Shoe control arm 120 and shoe 122 may be secured together using a cotter pin. Shoe 122 may be pivoted between its raised and lowered positions by pushing or pulling on handle 118.

As noted, components of control assembly 108 may be accessible to an operator of portable dispensing device 100. That is, each of agitation assembly 111, shoe control assembly 117, and valve control assembly 123 may be operated while an operator pushes on handle bars 110. Specifically, an operator may control and navigate portable dispensing device 100 using handle bars 110, agitate the sealant inside kettle 106 by engaging agitation handle 112, dispense melted sealant by engaging valve control handle 124, and fill cracks and smooth out dispensed sealant by engaging shoe control handle 118 during operation of portable dispensing device 100.

When an operator engages valve control handle 124, control valve 130 changes from its default closed position to its open position, allowing melted sealant to exit kettle 106 and housing 102 and be dispensed on a crack. The operator may further engage valve control handle 124 such that control valve 130 opens further, which may allow more melted sealant to exit kettle 106 and housing 102 to be dispensed on a crack.

As depicted in FIG. 2, portable dispensing device 100 further includes a fuel tank 136, a thermometer 138, a thermometer guard 140, a fuel tank chain 144, a fuel tank shelf 148, two front casters 148, two rear wheels 150, fuel hose clamp 152, and a fuel hose heat shield 155.

Thermometer 138 may be installed on housing 102. Thermometer 138 may be fastened to housing 102, e.g. using a combination of screws, nuts, and/or bolts. A portion of thermometer 138 may be exposed to the interior of kettle 106. For example, the portion of thermometer 138 for sensing temperature may extend into kettle 106. Thermometer 138 may identify the temperature in kettle 106. The temperature reading may allow an operator to monitor melting conditions in kettle 106 and determine if fuel supply should be increased, decreased, or maintained in order to provide the desired temperature for melting sealant.

In some embodiments, thermometer 138 may be replaced with a thermostat, which may be interconnected with an electrically-actuated fuel valve. The thermostat may be user-adjustable to a desired temperature set point based on the sealant deposited in kettle 106. The thermostat may provide an electrical signal to the fuel valve to increase fuel supply when the kettle temperature is below the set point, or decrease fuel supply when the kettle temperature is above the set point.

Thermometer guard 140 may be installed on housing 102. Thermometer guard 140 may be fastened to housing 102 using the appropriate fastening means, such as a combination of screws, nuts, and/or bolts. Thermometer guard 140 may be installed around thermometer 138 to protect thermometer 138 from being dislodged or damaged.

Figure 3:
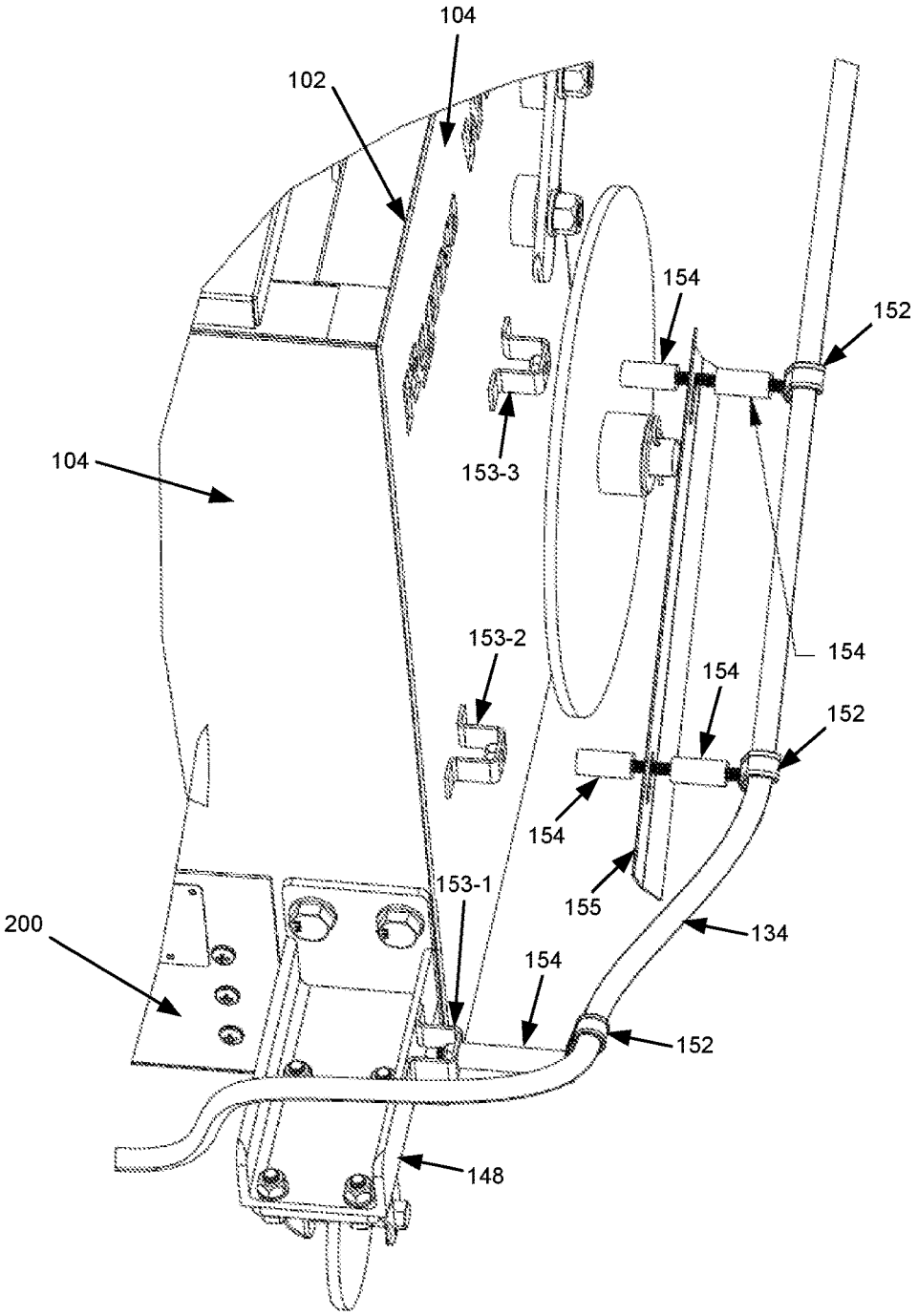
FIG. 3 is an enlarged partial perspective view of a portion of the portable dispensing device of FIG. 1, depicting a fuel hose and fuel hose clamps.

Portable dispensing device 100 may include one or more fuel hose clamps 152. As depicted in FIG. 3, fuel hose clamps 152 may comprise in part a loop sized to thread through fuel hose 134. Fuel hose clamps 152 may also comprise a hole to accommodate fastening means, such as a screw. Fuel hose clamps 152 may be fastened to housing 102 using appropriate fastening means, such as screws and a clamp bracket 153. As illustrated in FIG. 3, front caster 148 may include clamp bracket 153-1, and housing side wall 104 may include clamp bracket 153-2 and clamp bracket 153-3. A screw may be inserted into fuel hose clamp 152, which may be threaded into clamp bracket 153. The screw may be covered with one or more sleeves 154 so the threads may not be exposed. Fuel hose 134 may be made of a material that may not be rigid and may tend to sag, such as rubber. Fuel hose clamps 152 may secure fuel hose 134 to housing 102.

Portable dispensing device 100 may include a fuel hose heat shield 155. Fuel hose heat shield 155 may be secured to portable dispensing device 100 using one or more screws. Fuel hose heat shield 155 may be located between one or more brackets and one or more fuel hose clamps 152. In some embodiments, one or more spacers may be placed on the one or more screws so fuel hose heat shield 155 may not be in physical contact with any brackets or any fuel hose clamps 152.

Fuel hose heat shield 155 may prevent damage, in particular damage caused from heat, to fuel hose 134.

As depicted in FIG. 3, the portion of fuel hose 134 proximate to the front of portable dispensing device 100 near front caster 148 may be secured using fuel hose clamp 152 fastened to clamp bracket 153-1 on front caster 148. The portion of fuel hose 134 proximate to the housing side wall 104 of portable dispensing device 100 may be secured using one or more fuel hose clamps 152 fastened to clamp bracket 153-2 and clamp bracket 153-3 on housing side wall 104.

Fuel hose clamps 152 and clamp brackets 153 may prevent fuel hose 134 from dislodging from portable dispensing device 100 if portable dispensing device 100 suddenly moves, for example, if it is guided over a bumpy surface. In addition, fuel hose heat shield 155 may protect fuel hose 134 from damage caused by heat emanating from housing 102.

Figure 4:
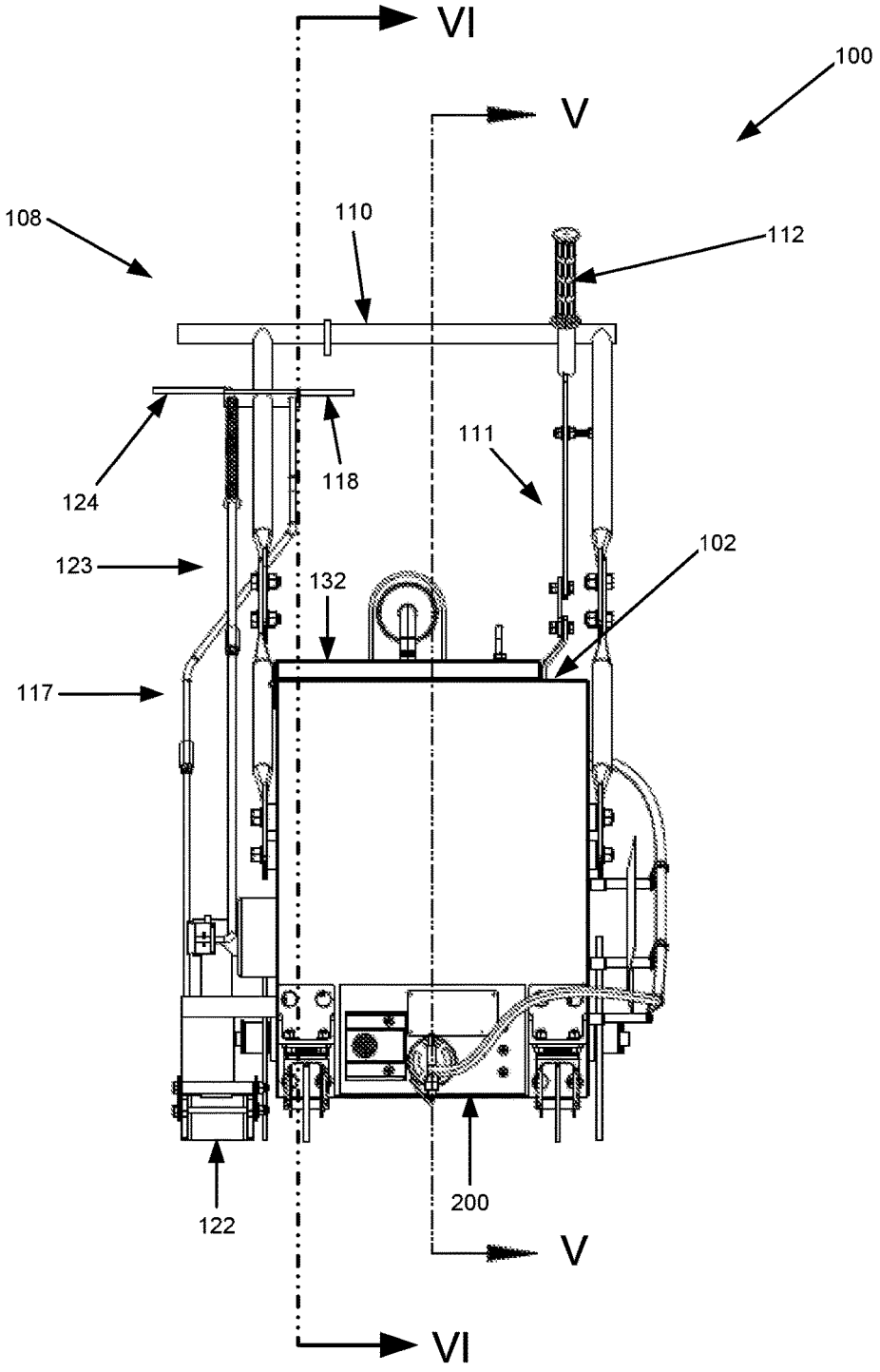
FIG. 4 is a front view of the portable dispensing device of FIG. 1.

FIG. 4 is a front view of portable dispensing device 100. As depicted in FIG. 4, removable burner assembly 200 is located between two front casters 148.

FIG. 5 is a cross-sectional view of portable dispensing device 100 along line V-V shown in FIG. 4. In some embodiments, kettle 106 is contained within housing 102 of portable dispensing device 100. Kettle 106 may have a shape similar to housing 102. For example, as depicted in FIG. 1 and FIG. 5, portable dispensing device 100 with a generally rectangular housing 102 contains a kettle 106, which may be likewise rectangular. Kettle 106 may include side walls and a bottom surface 156. As depicted in FIG. 5, bottom surface 156 is a flat surface. In some embodiments, bottom surface 156 may be rounded. In some embodiments, bottom surface 156 may be sloped towards control valve 130 to promote flow of melted sealant towards control valve 130.

Housing 102 may define an air gap 158 beneath kettle 106. Removable burner assembly 200 may be removably received in housing 102, such that it is disposed in air gap 158.

A guide mechanism may be mounted to housing 102 within air gap 158 and below kettle 106 for removably positioning a burner below the kettle. The guide mechanism may, for example, comprise one or more tracks 160. Tracks 160 may, for example, be welded or fastened to housing 102 using bolts, screws, or the like. Removable burner assembly 200 may be slidably received in tracks 160 such that it is removable from housing 102 by sliding along tracks 160.

Track plates 162 at the end of tracks 160 may limit inboard travel of removable burner assembly 200 along tracks 160 so that removable burner assembly 200 is positioned below kettle 106 to apply heat to bottom surface 156 of kettle 106. Track plates 162 may further prevent movement of removable burner assembly 200 during operation of portable dispensing device 100. Outboard travel of removable burner assembly 200 may be limited by a locking feature such as a detent or fastener (e.g. a screw, bolt, clip or the like) installed to secure removable burner assembly 200 to housing 102

Figure 6:
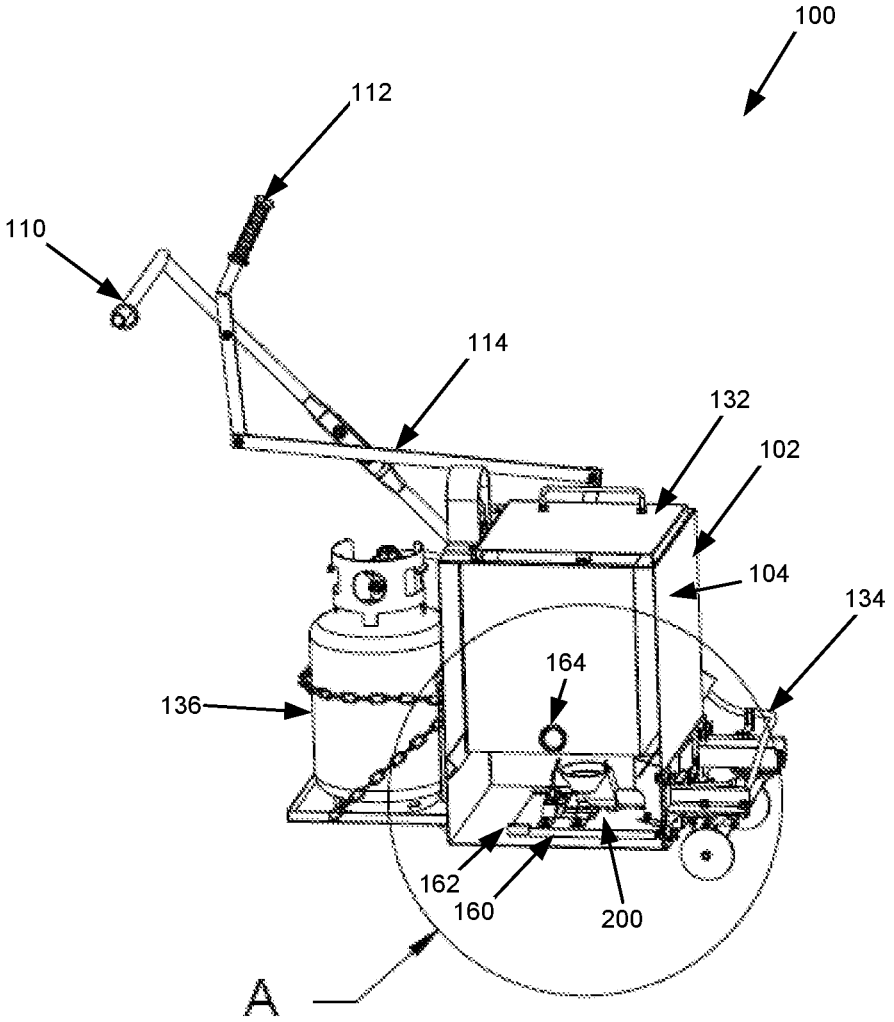
FIG. 6 is a perspective view of the portable dispensing device of FIG. 4 with a cutaway along line VI-VI shown in FIG. 4.
Figure 7:
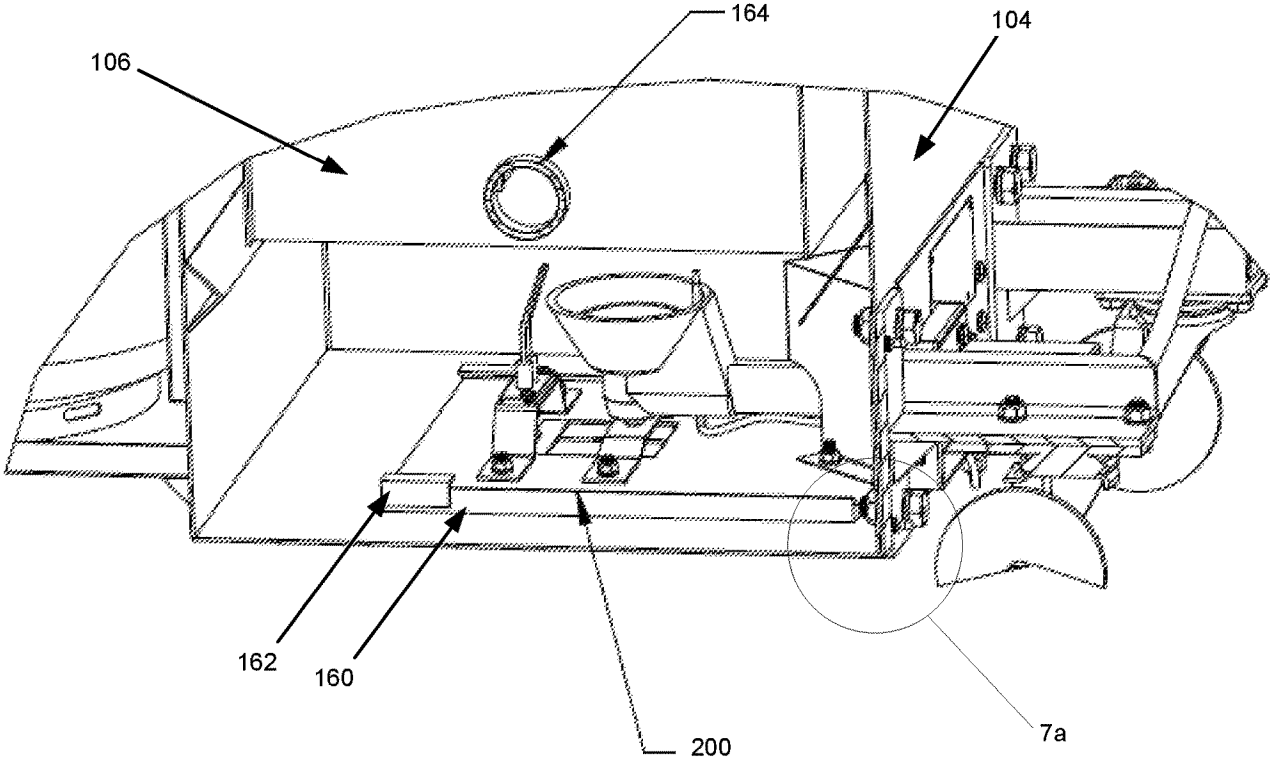
FIG. 7 is an enlarged view of the portion of the portable dispensing device of FIG. 6, the portion identified by window A shown in FIG. 6.

FIGS. 6-7 are cross-sectional views of portable dispensing device 100 along line VI-VI shown in FIG. 4, the latter enlarged to show details of removable burner assembly 200. FIG. 8 is a perspective view of an example removable burner assembly 200 removed from housing 102.

Removable burner assembly 200 may comprise ignitor electrodes 202, a burner 204, a burner head 206, a thermocouple 208, a thermocouple connection 210, a flameout valve 212, a flame-out override button 214, a burner air intake 216, and an air intake cut-out 218. Fuel may be delivered to burner head 206 from fuel hose 134, via flameout valve 212 and a fuel regulator 220. Removable burner assembly 200 may also include an ignition assembly 300. Components of removable burner assembly 200 may be mounted to a chassis 201.

Chassis 201 may have a base plate 201*a* and a back plate 201*b*. Chassis 201 is configured for reception through an opening 105 in housing 102 into air gap 158. Base plate 201*a* is sized for reception by tracks 160. That is, tracks 160 define a channel of width and height corresponding to that of base plate 201*a* so that base plate 201*a* may be snugly received to be slidable along tracks 160. Base plate 201*a* may alternatively or additionally carry tracks runners or rollers on its underside which mate to tracks 106 for sliding of removable burner assembly 200 into or out of housing 102.

Back plate 201*b* may be configured to substantially occlude opening 105 of housing 102 so that, when removable burner assembly 200 is fully installed within housing 102, back plate 201*b* substantially blocks wind. Blocking of wind by back plate 201*b* may reduce the vulnerability of the burner to flame-out.

Figure 7A:
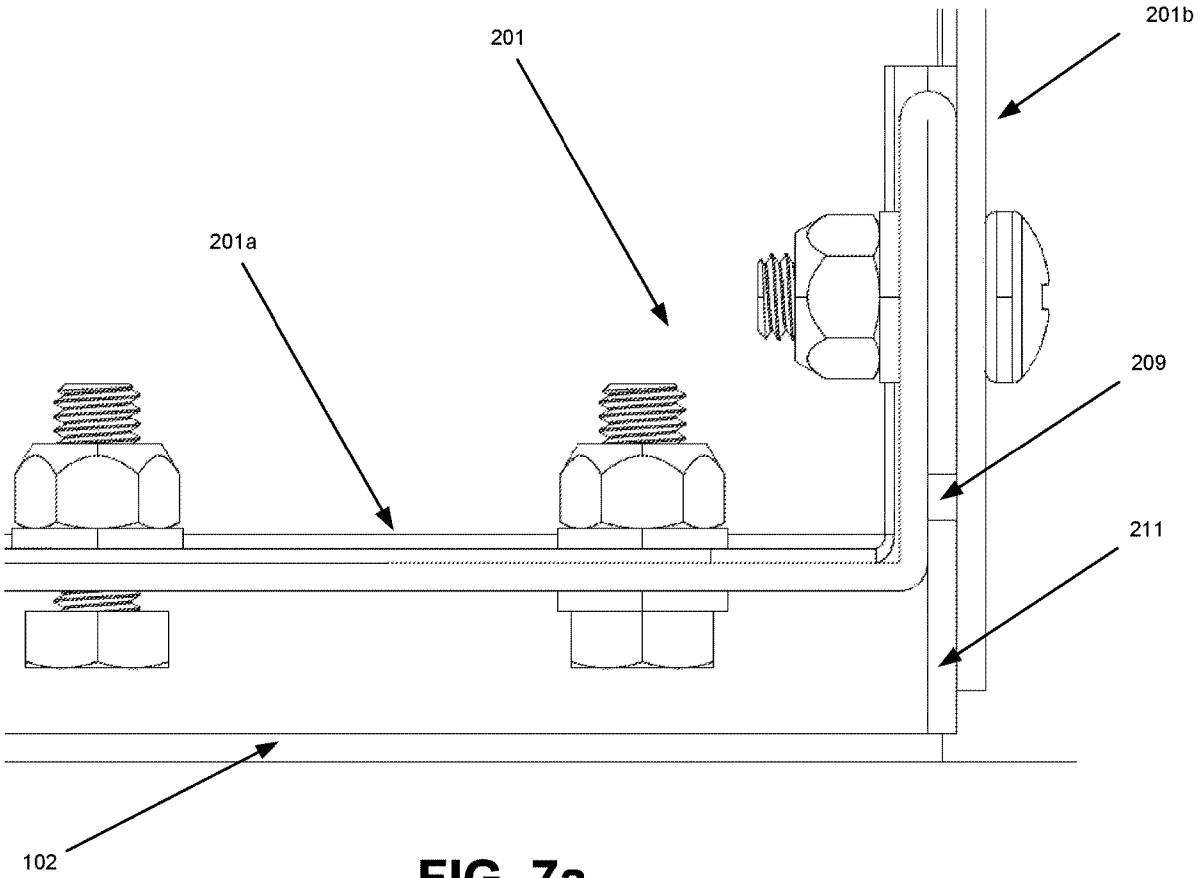
FIG. 7*a* is an enlarged partial cross-sectional view showing a portion of a removable burner assembly of the portable dispensing device of FIG. 6.

FIG. 7*a* depicts a portion of burner assembly 200 in enlarged cross-section. The portion depicted in FIG. 7*a* is identified by window VII-a in FIG. 7. For clarity, only components of housing 102 and chassis 201 are depicted in FIG. 7*a*, and other components are omitted. Chassis 201 may have a locking feature for fixing the location of burner assembly 200 relative to housing 102. For example, as depicted, chassis 201 has a notch 209 opening downwardly. When burner assembly 200 is fully received through opening 205 of housing 102, a corresponding lip 211 projecting upwardly from the floor of housing 102 is received in notch 209. Engagement between notch 209 and lip 211 removably retains burner assembly 200 in position, such that it is unlikely to be inadvertently bumped out of place during operation, but can be easily removed by an operator pulling against chassis 201. In other embodiments, burner assembly may be secured in place by another type of locking device, such as a latch or buckle, or a fastener such as a bolt or screw inserted through chassis 201 and housing 102.

Burner 204 and burner head 206 are mounted to chassis 201 so that burner head 206 faces upwardly with chassis 201 received in housing 102. Burner 204 and burner head 206 communicate with fuel line 134 by way of a conduit 203. Burner head 206 has a plurality of openings 205 through which fuel from conduit 203 may be supplied to a flame. Burner head 206 and openings 205 are configured so that burner head 206 produces an upwardly-directed flame.

As is best shown in FIG. 6, when removable burner assembly 200 is installed in housing 102, the location of burner head 206 is defined by tracks 160 in combination with plates 162 at the inboard end of tracks 160 and by back plate 201*b*, which abuts housing 102. In this position, burner head 206 is located beneath bottom surface 156 of kettle 106. Thus, when lit, burner head 206 produces an upwardly-directed flame which directly heats the underside of kettle 106. This configuration may provide improved efficiency relative to designs with, for example, horizontally-directed burners which may provide largely indirect heating of kettles.

A burner air intake 216 may be located on the side of removable burner assembly 200. Burner air intake 216 may mix air with fuel in fuel line 134 such that a combustible fuel-air mixture is delivered to burner head 206 through conduit 203. Conduit 203 has a coupling for connection to fuel line 134, with a flameout valve 212. As will be described in further detail below, flameout valve is configured to interrupt supply of fuel through conduit 203 when no flame is present at burner head 206.

Ignition assembly 300 may include ignitor electrodes 202 secured on removable burner assembly 200 near burner head 206. Ignitor wires 306 may electrically connect ignitor electrodes 202 with an ignition circuit 301. Ignitor electrodes 202 may provide a spark to ignite fuel delivered to burner head 206 and produce a flame. The flame in burner head 206 is directed upwardly toward bottom surface 156 of kettle 106.

FIG. 10 through FIG. 15 are exploded views depicting components of ignition assembly 300. As depicted, ignition assembly 300 includes an ignitor bracket assembly 302, ignitor bracket assembly screws 304, ignitor wires 306, an ignitor push button 308, an ignitor collar 310, an ignitor body 312, an ignitor bracket 318, an ignitor heat shield 322, and ignitor terminals 326.

Ignitor bracket assembly 302 may be fastened to chassis 201 with ignitor bracket assembly screws 304.

Figure 11B:
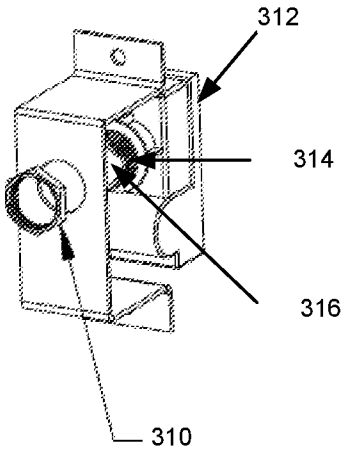
Figure 11A:
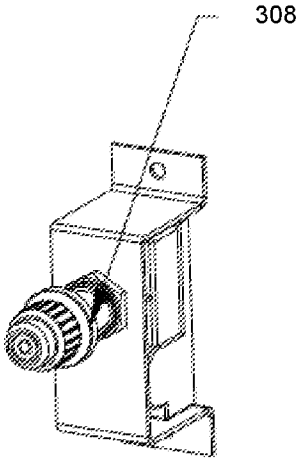

FIG. 11A and FIG. 11B depict exploded views of ignitor bracket assembly 302. Ignitor bracket assembly 302 may include ignitor push button 308, ignitor collar 310, and ignitor body 312. Ignitor body 312 may include a threaded portion 314 of ignitor body 312 and an ignitor battery opening 316 to receive a battery.

Ignitor push button 308 may be fastened, for example, threaded, to ignitor body 312. Ignitor collar 310 may also be threaded to ignitor body 312 to retain ignitor push button 308.

Figure 12:
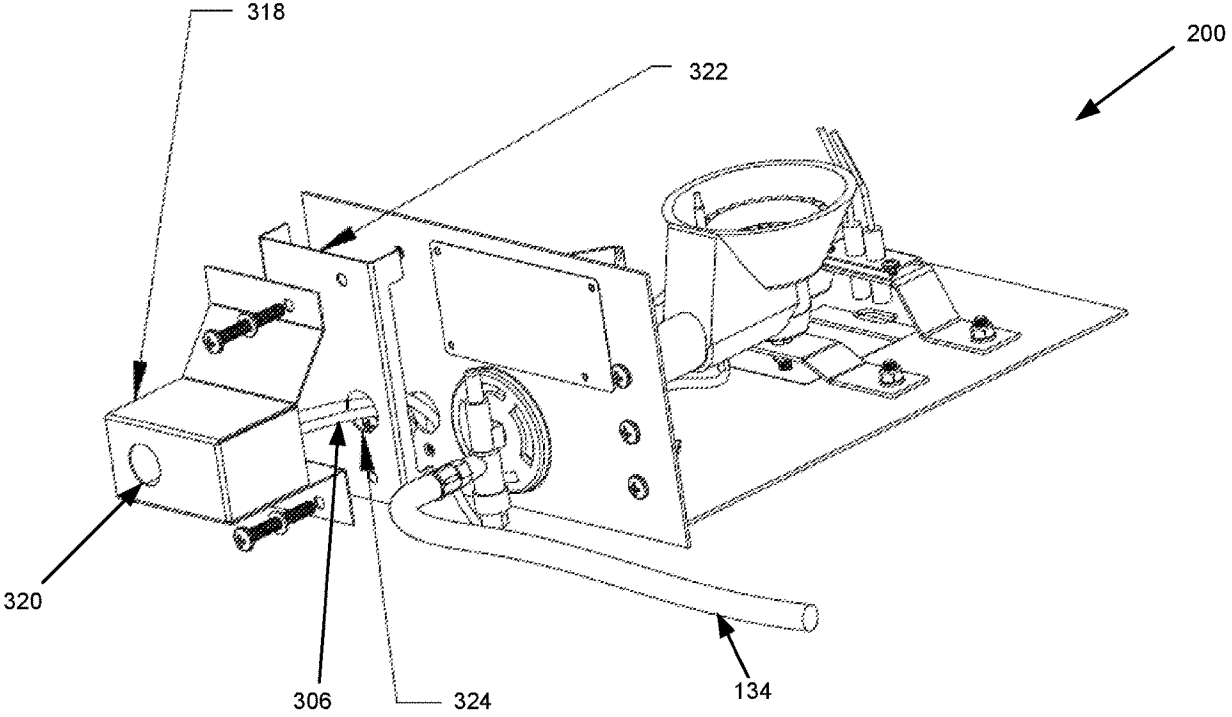

Ignitor bracket 318 and ignitor heat shield 322 may be installed on removable burner assembly 200. As depicted in FIG. 12, ignitor bracket 318 and ignitor heat shield 322 may be fastened to removable burner assembly 200 at generally the same location as where ignitor bracket assembly 302 was fastened to removable burner assembly 200. Ignitor bracket 318 and ignitor heat shield 322 may be fastened to removable burner assembly 200, for example, using screws and washers.

Figure 13:
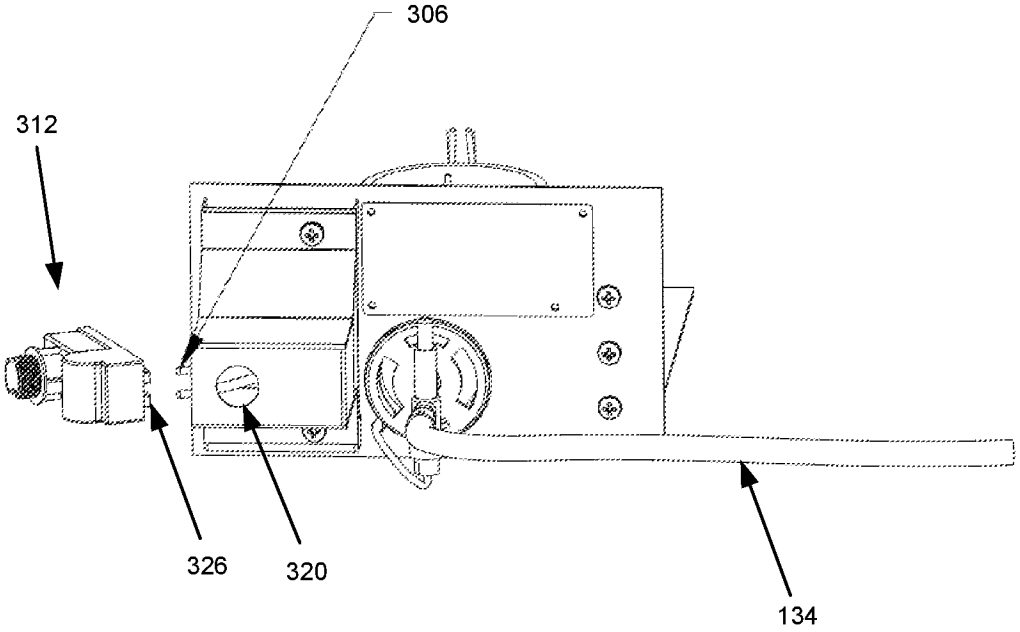
Figure 14:
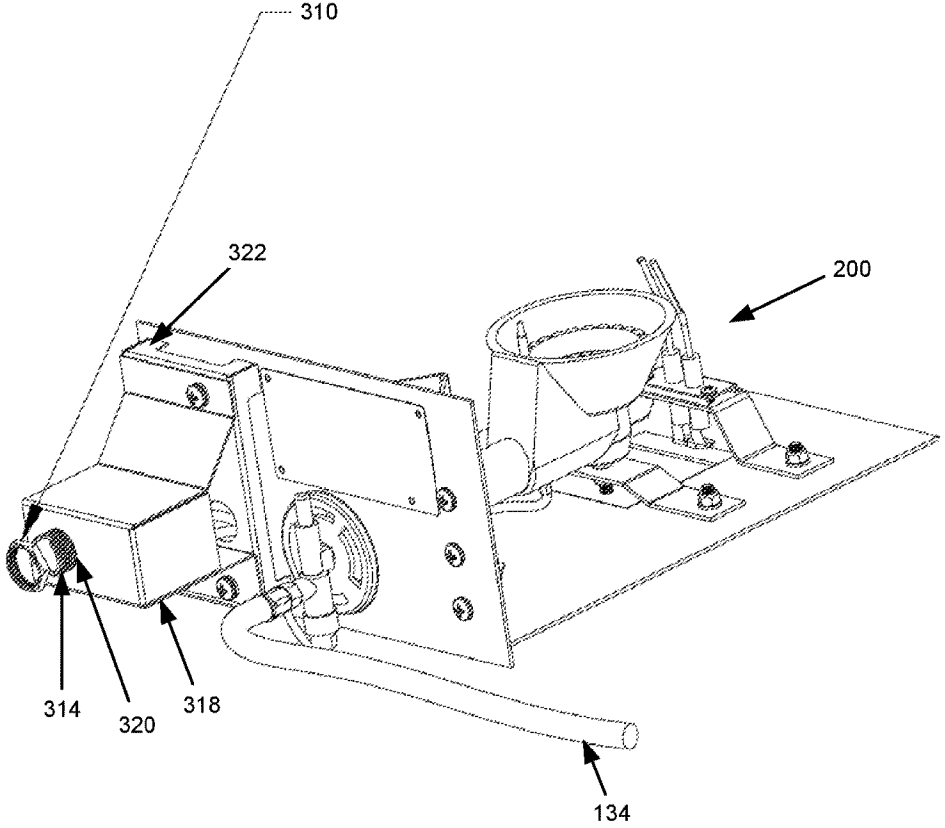

Ignitor bracket 318 may provide a structure to support at least some of the components of ignition assembly 300. Ignitor bracket 318 may include ignitor bracket hole 320. Ignitor bracket hole 320 may be manufactured on ignitor bracket 318, for example, by punching ignitor bracket hole 320 through ignitor bracket 318. Ignitor bracket hole 320 may accommodate the shape and orientation of ignitor body 312 when ignitor body 312 is installed. As depicted in FIG. 12 through FIG. 14, ignitor bracket hole 320 is sized to accommodate threaded portion 314 of ignitor body 312.

Ignitor heat shield 322 may protect ignition assembly 300 from the heat generated by burner 204 of removable burner assembly 200. Ignitor heat shield 322 may include an ignitor heat shield hole 324. Ignitor electrodes 202 and ignition assembly 300 may be connected by ignitor wires 306 threaded through heat shield hole 324. Thus, ignitor wires 306 may not have to be wrapped around ignitor heat shield 322.

As depicted in FIG. 13, ignitor wires 306 may be connected to ignitor terminals 326 located at the rear of ignitor body 312. There may be two ignitor terminals 326 located at the rear of ignitor body 312, the first representing a positive terminal, and the second representing a negative terminal.

Figure 15:
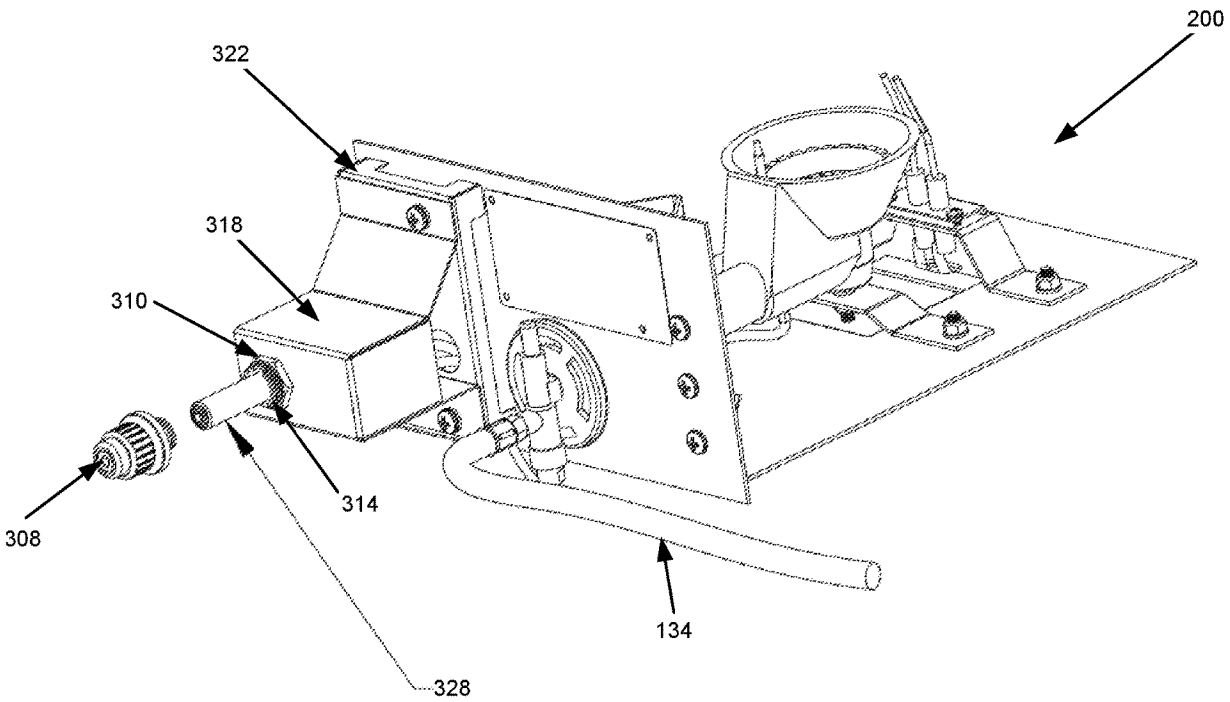

As depicted in FIG. 15, a battery 328 may be inserted into ignitor battery opening 316. Battery 328 may, for example, be an AA battery. As depicted in FIG. 15, the positive side of battery 328 is facing outwards away from removable burner assembly 200. Battery 328 may provide electrical power for ignition assembly 300 to cause a spark to form at ignitor electrodes 202.

When ignitor push button 308 is pushed, it may close ignition circuit 301 formed between battery 328, ignitor wires 306, and ignitor electrodes 202. This may cause a spark to form between ignitor electrodes 202. This spark may cause fuel supplied from fuel tank 136 to removable burner assembly 200 to ignite, creating a flame in burner 204 to melt sealant in kettle 106. Ignitor push button 308 may include a spring inside ignitor push button 308, so that ignitor push button 308 is biased to an open position.

With ignition assembly 300 fastened to removable burner assembly 200 and located outside housing 102, and removable burner assembly 200 located inside housing 102, burner 204 of removable burner assembly 200 may be ignited using ignition assembly 300 without removing removable burner assembly 200 from housing 102. This may provide convenience during operation of portable dispensing device 100, as burner 204 may be ignited without removal of removable burner assembly 200 and then reinsertion into housing 102. It may also allow burner 204 to be ignited while inside housing 102, which may prevent wind from extinguishing the flame during ignition.

Referring again to FIGS. 6-8, removable burner assembly 200 includes a thermocouple 208 for monitoring flame condition at burner head 206. Thermocouple 208 is fastened proximate to burner head 206. Thermocouple 208 is in electric connection with flameout valve 212 via thermocouple connection 210. For example, thermocouple connection 210 may be connected to thermocouple 208 on one end, and may be connected to flameout valve 212 on the other end. The end that may be connected to flameout valve 212 may be threaded. Flameout valve 212 may comprise a threaded portion to receive the threaded end of thermocouple connection 210.

Thermocouple 208 may produce a voltage dependent on its temperature. When a flame is present at burner head 206, thermocouple 208 may produce a relatively large voltage, which may be provided to flameout valve 212 to keep flameout valve 212 open. With flameout valve 212 open, fuel from fuel tank 136 may be delivered to burner head 206 through conduit 203 so a flame may be maintained. Conversely, if there is no flame in burner head 206, thermocouple 208 may not provide sufficient voltage to open flameout valve 212. Thus, during a flameout or when portable dispensing device 100 is not in operation, flameout valve 212 may be closed so fuel may not enter removable burner assembly 200.

In some embodiments, thermocouple 208 may include a plurality of thermocouples connected in series (e.g., a thermopile). Such a configuration may provide larger voltage or current for opening flameout valve 212.

Flameout valve 212 may have a flameout override button 214 to allow manual opening of flameout valve 212 such that flameout valve 212 can be opened even if the temperature of thermocouple 208 is low. Flameout override button 214 may be used during the ignition of removable burner assembly 200.

A heat shield 207 may be installed against the interior surface of chassis back plate 201*b*, interposed between burner head 206 and ignitor assembly 300. Heat shield 207 may reflect heat away from ignitor assembly 300, protecting against damage to components of ignitor assembly 300 and fuel hose 134. In addition, heat shield 207 may protect against operator burns or discomfort. For example, heat shield 207 may provide protection against an operator being burned while operating override button 214. As depicted, heat shield 207 has a pair of angled baffles which converge in the direction of burner head 206, defining a triangular cross-section. In other embodiments, heat shield 207 may be configured differently. For example, heat shield 207 has one or more flat baffles generally parallel to back plate 201*b*.

Fuel regulator 220 may be connected to fuel hose 134. Fuel regulator 220 may have a threaded coupling to connect with fuel hose 134. Fuel regulator 220 may also be connected to fuel tank 136, for example, with another threaded coupling. The threaded couplings may be tightened by hand. Fuel regulator 220 may regulate the amount of fuel supplied to removable burner assembly 200, which may affect the amount of heat that removable burner assembly 200 may apply to kettle 106 to melt the sealant.

Fuel regulator 220 may be adjusted by an operator to control the amount of heat applied to the sealant by removable burner assembly 200. For example, when the sealant is solid, an operator may adjust fuel regulator 220 such that removable burner assembly 200 may apply more heat to kettle 106 to melt the sealant. When the sealant has melted, an operator may adjust fuel regulator 220 such that removable burner assembly 200 may apply less heat to kettle 106 to avoid creating hot spots on bottom surface 156 of kettle 106 and to avoid solidifying or burning the melted sealant.

An air intake cut-out 218 may be located on the bottom of removable burner assembly 200. Air intake cut-out 218 may provide air flow through housing 102. Specifically with a flame ignited at burner head 206, air may be drawn in through air intake cut-out 218, heating, and rise past kettle 106 and out of housing 102 through vents 103. This bottom-to-top ventilation of housing 102 may mitigate the effect of wind surrounding portable dispensing device 100 and may limit the likelihood of wind-induced flameout. Specifically, since wind gusts typically flow generally horizontally, wind gusts indirectly enter housing 102 through air intake cut-out 218.

As described above and depicted in FIGS. 1-15, ignition assembly 300 is mounted directly to housing 102. In other embodiments, ignition controls may be provided on or proximate handle bar 110 so that an operator may operate the ignitor while pushing the dispensing device. For example, an ignition button may be mounted on handle bar 110 and wired to ignitor electrodes 202. In such embodiments, ignitor electrodes 202 may be mounted directly to housing 102 rather than being mounted to chassis 201 of the removable burner assembly. In addition to or instead of flameout override button 214, a flameout override button may be provided on or proximate handle bar 110 for ease of simultaneous operation with handle bar-mounted ignitor controls. The handle bar-mounted flameout override button may, for example, operate an electrical circuit to open flameout valve 212. The ignitor circuit and flameout override circuit may be powered by a common power source (e.g. a battery) or they may have separate power sources.

Figure 16:
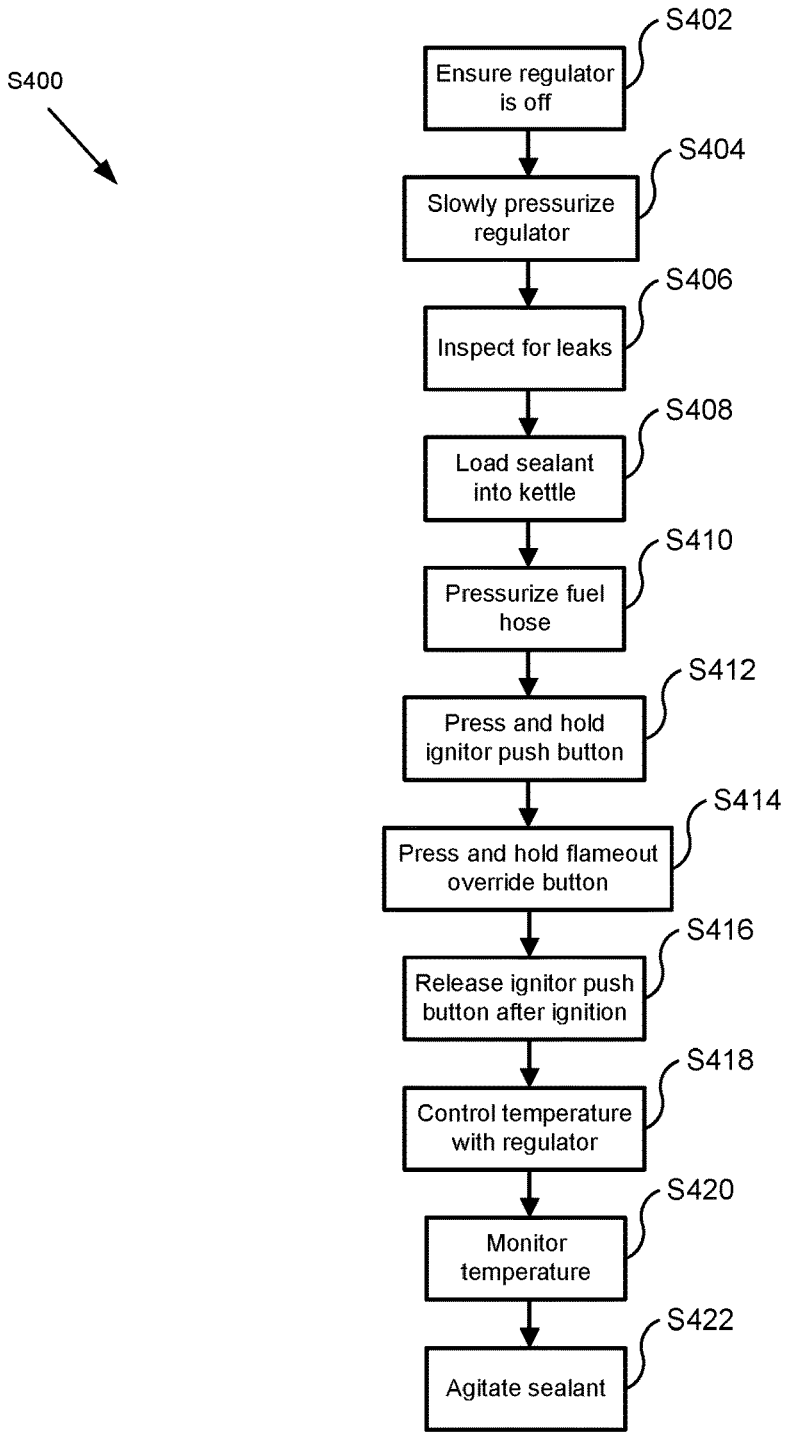
FIG. 16 is a flow chart depicting a method of loading the portable dispensing device of FIG. 1 with sealant and igniting the burner of the removable burner assembly of FIG. 8.
Figure 17:
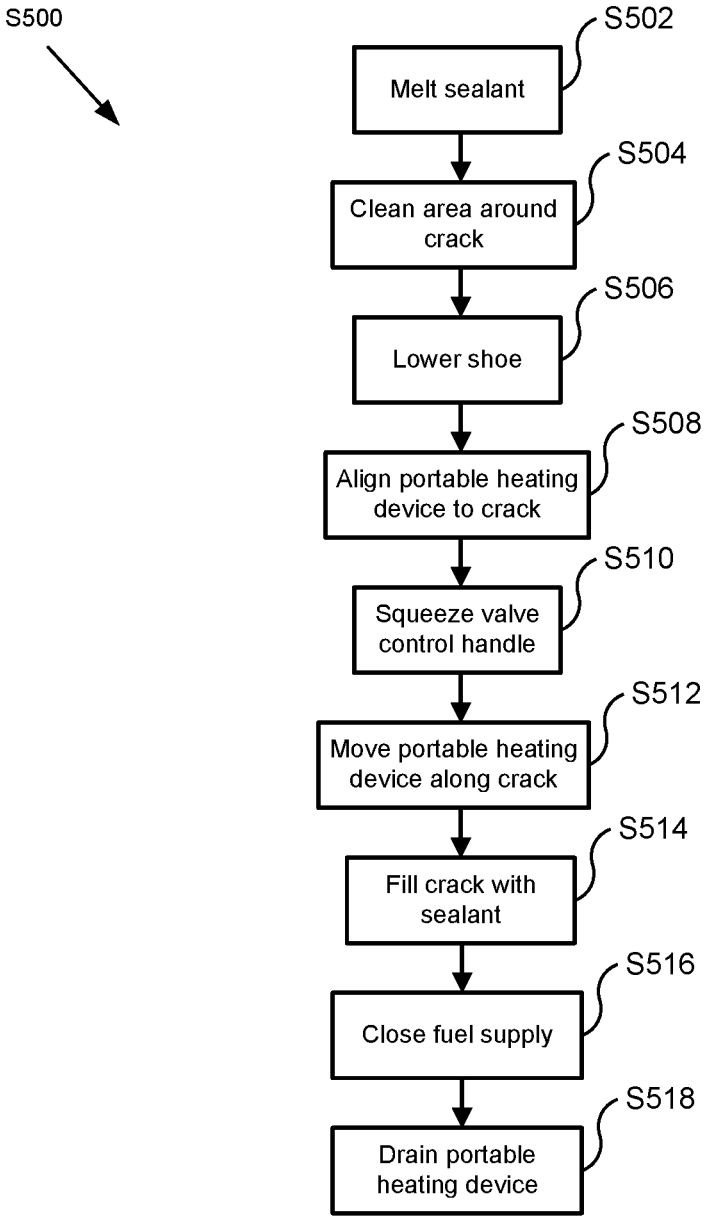
FIG. 17 is a flow chart depicting a method of applying sealant to a crack in a surface with the portable dispensing device of FIG. 1.

FIGS. 16-17 depict a method of sealing cracks with portable dispensing device 100. FIG. 16 depicts a process S400 for loading sealant into an example portable dispensing device 100 and lighting removable burner assembly 200. FIG. 17 depicts a process S500 for applying sealant to a crack in a paved surface.

Referring to FIG. 16, at block S402, fuel regulator 220 is closed to ensure no fuel is being supplied to conduit 203 and burner head 206 from fuel tank 136. Typically, fuel regulator 220 may include a rotatable knob for opening or closing fuel regulator 220.

At block S404, fuel regulator 220 is slowly pressurized by rotating fuel tank valve 142 located on fuel tank 136.

At block S406, the connection between fuel tank 136 and fuel regulator 220 is inspected for leakage.

At block S408, sealant is loaded into kettle 106. Typically, lid 132 is opened to allow sealant to be loaded into kettle 106. Sealant may be loaded in solid or liquid form and typically, rests on bottom surface 156 of kettle 106. In an example, the sealant may be bitumen and may be loaded as one or more solid blocks.

At block S410, fuel regulator 220 is turned on, typically by turning the knob on fuel regulator 220, to pressurize fuel hose 134. Opening of fuel regulator allows delivery of fuel to removable burner assembly 200. The connections between removable burner assembly 200 and fuel hose 134, and the connection between fuel hose 134 and fuel regulator 220, are inspected for leakage.

At block S412, removable burner assembly 200 is ignited by pressing and holding ignitor push button 308, and then, at block S414, pressing and holding flameout override button 214. Both ignitor push button 308 and flameout override button 214 are held until burner 204 of removable burner assembly 200 ignites. The air supply for igniting burner 204 may come from burner air intake 216 and air intake cut-out 218.

At block S416, once burner 204 is ignited, ignitor push button 308 may be released, but flameout override button 214 is held until thermocouple 208 warms up. Typically, it may take about 15 to 20 seconds of continuously pressing flameout override button 214 in order for thermocouple 208 to reach an operating temperature. Thereafter, while a flame is present at burner head 206, thermocouple 208 may provide voltage to flameout valve 212 to keep flameout valve 212 open, such that fuel from fuel tank 136 may continue to be supplied to burner 204 of removable burner assembly 200 without continuing to press flameout override button 214.

At block S418, once burner 204 ignited, the temperature may be controlled by adjusting fuel regulator 220, typically with a knob on fuel regulator 220.

At block S420, the temperature of kettle 106 may be monitored by viewing the reading on thermometer 138. Fuel regulator 220 may be adjusted such that the temperature of kettle 106 is in the preferred melting temperature range for the particular sealant, as may be specified by the sealant manufacturer. In some examples, the sealant may be Dura-Fill HS™ or Dura-Fill PL™ sealant produced by P&T Products Inc. of Sandusky, Ohio, USA and the desired temperature of molten sealant for application may be approximately 350-400 degrees fahrenheit. In other examples, the sealant may be Nuvo Elite B™ produced by Maxwell Products Inc. of Salt Lake City, Utah, USA and the desired temperature of molten sealant for application may be approximately 380 degrees fahrenheit. In other examples, the sealant may be Superflex HT™ produced by Crafco Inc. of Chandler, Ariz., USA and the desired temperature of molten sealant for application may be approximately 380-400 degrees fahrenheit. Burner 204 may need to be turned off periodically if the sealant material becomes too hot.

At block S422, while sealant is melting in kettle 106, agitation handle 112 may be engaged to stir the sealant in kettle 106 with agitator 116. Agitation of the sealant in kettle 106 with agitator 116 may move solid sealant material along bottom surface 156 of kettle 106 and may prevent hot spots from forming. Overheating the sealant may reduce its effectiveness when applied to a crack. Agitation may also prevent portions of over-heated sealant material from hardening and solidifying, which may plug or block control valve 130 and/or flow valve tube 164. A plugged or blocked control valve 130 and/or flow valve tube 164 may slow down the process of dispensing melted sealant to perform maintenance on a paved surface, such as a road or a driveway.

If a flameout occurs, fuel regulator 220 may be turned off and fuel tank 136 may be closed to discontinue the supply of fuel to removable burner assembly 200. Portable dispensing device 100 should be free and clear of any gas odours before burner 204 of removable burner assembly 200 is re-ignited.

Referring to FIG. 17 a process S500 for applying sealant to a crack in a paved surface is depicted.

At S502, sealant may be melted, for example using the method described in S400 of FIG. 16.

At S504, the area surrounding the crack may be cleared of debris, such as dirt and vegetation, so the melted sealant may enter the crack and adhere to the paved surface.

At S506, shoe 122 may be lowered by engaging shoe control handle 118 so that grading blade 121 rests on the paved surface. Shoe 122 may promote filling the crack with melted sealant, and may smooth out the sealant dispensed by portable dispensing device 100.

At S508, portable dispensing device 100 may be aligned with the crack such that the crack to be filled is generally aligned with the centre of shoe 122.

At S510, valve control handle 124 may be engaged to dispense melted sealant onto the crack. For example, as depicted in FIG. 1, valve control handle 124 may be pulled towards handle bar 110 to dispense melted sealant.

At S512, portable dispensing device 100 may be moved along the crack to dispense melted sealant into the crack. As portable dispensing device 100 is moved along the crack, portable dispensing device 100 may be guided so that the crack is generally aligned with the centre of shoe 122 for the dispensed sealant to fill in the crack.

At S514, the crack may be filled by melted sealant. The flow of sealant out of portable dispensing device 100 may be controlled by the amount of engagement of valve control handle 124. Increasing engagement of valve control handle 124 may increase the flow of melted sealant out of portable dispensing device 100. Decreasing engagement of valve control handle 124 may decrease the flow of melted sealant out of portable dispensing device 100.

If flow of sealant out of portable dispensing device 100 decreases without decreasing engagement of valve control handle 124, additional sealant may need to be melted in kettle 106 and kettle 106 may be agitated with agitator 116 to clear control valve 130 and/or flow valve tube 164.

At S516, to turn off burner 204, fuel regulator 220 may be turned off and fuel tank 136 may be closed to prevent fuel from being supplied from fuel tank 136 to burner 204. Removable burner assembly 200 may be slidably removed from housing 102 and burner 204 may be inspected to confirm that the flame is extinguished.

At S518, kettle 106 and control valve 130 are drained so that no sealant remains inside kettle 106 or control valve 130. A drained and clear control valve 130 may prevent blockage of control valve 130 by hardened sealant that was not drained after using portable dispensing device 100.

Before each use of portable dispensing device 100, the level of fuel tank 136 may be checked and fuel tank 136 should be refilled as necessary, fuel regulator 220 and fuel hose 134 may be inspected for physical damage and leaks, front casters 148 may be inspected and grease should be applied and fasteners of front casters 148 may be tightened as required, and thermometer 138 may be inspected for physical damage or malfunctions.

After portable dispensing device 100 has been used, control valve 130 may be cleaned. For example, control valve 130 may be cleaned after portable dispensing device 100 has accumulated 25 hours of use.

In addition, after portable dispensing device 100 has been used, the left and right side wheel bushings of front casters 148 and rear wheels 150 may be removed and replaced. For example, the left and right side wheel bushings may be removed and replaced after portable dispensing device 100 has accumulated 75 hours of use.

As described above, burner assembly 200 is slidably installed within housing 102 using a guide mechanism, namely, by reception in tracks 160. The guide mechanism maintains desired positioning of burner assembly 200, with burner head 206 positioned below kettle 106 to direct a flame upwardly toward the bottom of kettle 106. Precise and consistent positioning of an upwardly-directed burner directly beneath kettle 106 may provide for effective and efficient heating of the kettle relative to conventional torch-style burners. Moreover, tracks 160 permit easy removal and reinstallation of burner assembly 200, allowing easy access for maintenance and the like.

Other guide mechanisms are possible. For example, chassis 201 of burner assembly 200 may have tracks, runners or rollers on its underside, which may mate to tracks 160. In some embodiments, tracks 160 may be omitted, and chassis 201 may be slidably inserted in housing 102 by sliding on runners or rollers along the floor of housing 102.

In some embodiments, housing 102 may include a door over opening 105. The door may, for example, be hingedly or slidably mounted to housing 102 to permit access to opening 105. Back wall 201*b* of chassis 201 may be omitted in such embodiments.

Figure 18:
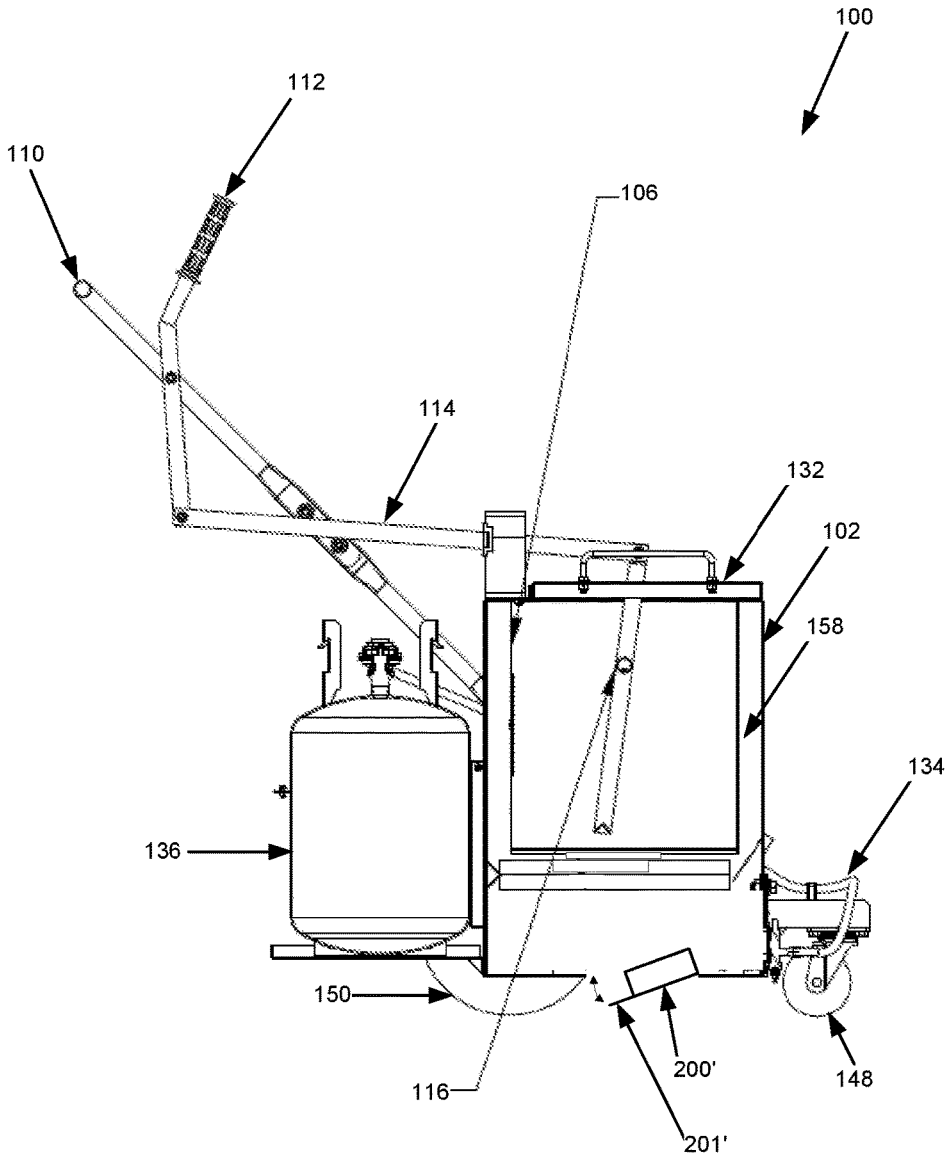
FIG. 18 is a perspective view of another dispensing device.

In other embodiments, the burner assembly may be mounted to a door in the floor of housing 102, which may be hinged to open downwardly. The burner assembly may be removed from the enclosure defined by housing 102 by pivoting the door downwardly. With the door open, the burner assembly may be accessible beneath housing 102. For example, FIG. 18 depicts a dispensing device 100' which is generally similar to dispensing device 100, except that burner assembly 200' is mounted to a hinged door 201' that pivots downwardly from the bottom of housing 102.

Figure 19:
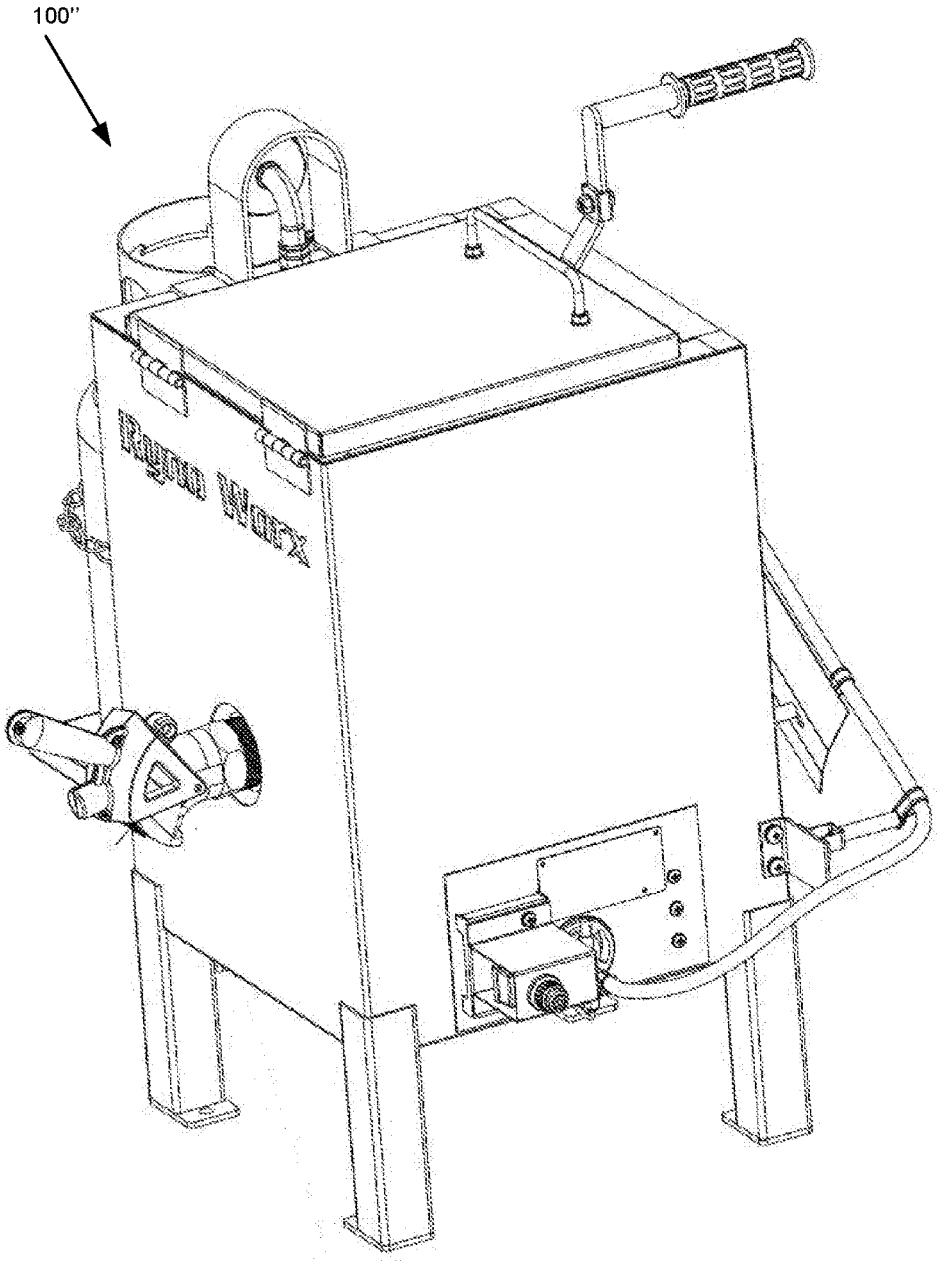
FIG. 19 is a perspective view of another dispensing device.

As described above, dispensing device 100 includes casters 148, wheels 150 and handle bar 110 for manually pushing the dispensing device to dispense sealant along the length of a crack. In other embodiments, dispensing device 100 may be designed for stationary use, and may lack casters 148 and wheels 150. FIG. 19 depicts an example dispensing device 100", which is generally similar to device 100 except that it lacks wheels or casters.

The preceding discussion provides many example embodiments. Although each embodiment represents a single combination of inventive elements, other examples may include all possible combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps As can be understood, the examples described above and illustrated are intended to be exemplary only. The invention is defined by the appended claims.

What is claimed is:

1. A portable dispensing device for dispensing a crack sealant, comprising:

an outer housing;

a melting kettle for holding said crack sealant to be melted;

a burner assembly mounted below the melting kettle in an air gap between the outer housing and the melting kettle;

a control valve fluidly connected to the melting kettle to dispense melted crack sealant;

a handle assembly for manually moving said portable dispensing device; and an agitator assembly for agitating crack sealant within said kettle, the agitator assembly having a control handle mounted to said handle assembly.

2. The portable dispensing device of claim 1, wherein the removable burner assembly is mounted to said outer housing on tracks and removable from said outer housing by sliding along said tracks.

3. The portable dispensing device of claim 1, wherein the removable burner assembly directs a flame upwardly against a bottom surface of the melting kettle to melt the crack sealant.

4. The portable dispensing device of claim 1, wherein said removable burner assembly is configured for reception through an opening in said outer housing, and wherein said removable burner assembly comprises a chassis configured to block said opening when received in said outer housing.

5. The portable dispensing device of claim 1, comprising an intake vent in said outer housing.

6. The portable dispensing device of claim 1, wherein the removable burner assembly comprises an ignition electrode to ignite the removable burner assembly and an ignition control device positioned outside said outer housing to ignite said burner without removing the removable burner assembly from the portable dispensing device.

7. The portable dispensing device of claim 1, wherein the removable burner assembly comprises a heat shield interposed between a burner and said ignition control device.

8. The portable dispensing device of claim 1, comprising a shoe for directing said sealant into a crack, with a trailing blade for smoothing a surface of said sealant.

9. The portable dispensing device of claim 1, wherein the crack sealant is an asphalt sealant.

10. The portable dispensing device of claim 1, wherein said agitator assembly comprises an agitator interconnected with said control handle by way of one or more pivotably-connected links.

11. The portable dispensing device of claim 1, wherein said control handle is pivotably connected to said handle assembly.

12. The portable dispensing device of claim 1, comprising a valve actuation control mounted to said handle assembly.

13. The portable dispensing device of claim 1, comprising a guide mechanism in said housing below said kettle for positioning a burner below said kettle, wherein said burner assembly is removably mounted to said guide assembly.

14. A method for dispensing a crack sealant, comprising:

inserting sealant in a melting kettle within a housing of a dispenser, said melting kettle positioned above a burner assembly;

inserting a burner assembly through an opening in said dispenser housing;

igniting said flame at said burner by operation of an ignition control device outside said housing;

manually moving said portable dispensing device using a handle assembly;

agitating sealant within said melting kettle by operating an agitator handle mounted to said handle assembly; and depositing molten sealant into a crack by manually moving said dispenser along said crack.

15. The method of claim 14, wherein said inserting said burner assembly comprises sliding said burner assembly along tracks in said housing of said dispenser tracks.

16. The method of claim 14, wherein said inserting said burner assembly comprises blocking said opening in said housing with a back plate of said burner assembly.

17. The method of claim 14, comprising drawing air through an intake vent in said housing.

18. The method of claim 14, wherein said igniting comprises pushing an ignition button to create a spark at an electrode.

19. A portable dispensing device for dispensing a crack sealant, comprising:

an outer housing;

a melting kettle for holding said crack sealant to be melted;

a burner assembly mounted in said housing below said melting kettle using said guide mechanism, the removable burner assembly configured to direct a flame against a surface of the melting kettle; and a control valve fluidly connected to the melting kettle to dispense melted crack sealant a handle assembly for manually moving said portable dispensing device; and an agitator assembly for agitating crack sealant within said kettle, the agitator assembly having a control handle mounted to said handle assembly.

* * * * *